US010056701B2

(12) United States Patent
Petropoulos

(10) Patent No.: US 10,056,701 B2
(45) Date of Patent: Aug. 21, 2018

(54) MULTIBAND WIFI DIRECTIONAL ANTENNAS

(71) Applicant: Laird Technologies, Inc., Earth City, MO (US)

(72) Inventor: Athanasios Petropoulos, Hudson, NH (US)

( * ) Notice: Subject to any disclaimer, the term of this patent is extended or adjusted under 35 U.S.C. 154(b) by 1 day.

(21) Appl. No.: 15/142,355

(22) Filed: Apr. 29, 2016

(65) Prior Publication Data

US 2017/0317428 A1 Nov. 2, 2017

(51) Int. Cl.

| | |
|---|---|
| ***H01Q 21/00*** | (2006.01) |
| ***H01Q 19/10*** | (2006.01) |
| ***H01Q 21/24*** | (2006.01) |
| ***H01Q 1/22*** | (2006.01) |
| ***H01Q 5/50*** | (2015.01) |
| ***H01Q 1/48*** | (2006.01) |

(52) U.S. Cl.

CPC ..... *H01Q 21/24* (2013.01); *H01Q 1/2291* (2013.01); *H01Q 1/48* (2013.01); *H01Q 5/50* (2015.01); *H01Q 19/10* (2013.01); *H01Q 21/0075* (2013.01)

(58) Field of Classification Search

CPC .... H01Q 1/246; H01Q 21/0081; H01Q 21/26; H01Q 3/36; H01Q 1/50; H01Q 3/34; H01Q 19/10; H01Q 1/2291; H01Q 1/48; H01Q 21/0075; H01Q 21/24; H01Q 5/50; H01Q 21/00

See application file for complete search history.

(56) References Cited

U.S. PATENT DOCUMENTS

| | | | | |
|---|---|---|---|---|
| 5,181,042 A | | 1/1993 | Kaise et al. | |
| 5,841,401 A | * | 11/1998 | Bodley | H01Q 1/246 343/700 MS |
| 5,905,465 A | * | 5/1999 | Olson | H01Q 1/246 33/34 |
| 6,028,563 A | * | 2/2000 | Higgins | H01Q 1/246 343/797 |
| 6,034,649 A | * | 3/2000 | Wilson | H01Q 1/246 343/795 |
| 9,000,991 B2 | | 4/2015 | Ramberg et al. | |

(Continued)

FOREIGN PATENT DOCUMENTS

EP 0484241 A1 5/1992

OTHER PUBLICATIONS

Parabolic antenna JRC-35 Duplex, http://en.jirous.com/antenna-5ghz-panel-sector, accessed Apr. 28, 2016, 2 pages.

(Continued)

*Primary Examiner* — Tho G Phan

(74) *Attorney, Agent, or Firm* — Harness, Dickey & Pierce, P.L.C.; Anthony G. Fussner

(57) ABSTRACT

Disclosed are exemplary embodiments of multiband WiFi directional antennas. In an exemplary embodiment, an antenna generally includes a base plate, a plurality of vertically polarized antenna element modules on the base plate, and a plurality of horizontally polarized antenna element modules on the base plate. Each antenna element module includes a radiating element and a ground plane/reflector. The antenna may be operable within at least a first WiFi frequency range and a second WiFi frequency range different than the first WiFi frequency range.

20 Claims, 24 Drawing Sheets

(56) References Cited

U.S. PATENT DOCUMENTS

| | | | | |
|---|---|---|---|---|
| 9,692,130 | B2 | 6/2017 | Nakamura et al. | |
| 9,716,318 | B2 | 7/2017 | Shirley et al. | |
| 2002/0163477 | A1* | 11/2002 | Eriksson | H01Q 1/246 343/815 |
| 2009/0167611 | A1 | 7/2009 | Hsu et al. | |
| 2009/0278746 | A1 | 11/2009 | Aurinsalo et al. | |
| 2010/0103066 | A1 | 4/2010 | Shtrom et al. | |
| 2010/0119002 | A1 | 5/2010 | Hartenstein | |
| 2010/0127949 | A1* | 5/2010 | Shimizu | H01Q 1/246 343/810 |
| 2010/0214190 | A1* | 8/2010 | Shin | H01Q 19/021 343/834 |
| 2011/0001683 | A1 | 1/2011 | Hsu et al. | |
| 2014/0054378 | A1 | 2/2014 | Bellows | |
| 2014/0118191 | A1 | 5/2014 | Smith et al. | |
| 2015/0102971 | A1* | 4/2015 | Liu | H01Q 21/26 343/798 |
| 2016/0105228 | A1 | 4/2016 | Cook | |

OTHER PUBLICATIONS

Combined Search Report and Examination Report from Great Britain Application No. GB1706937.8 filed May 20, 2017 (published as GB2549858 dated Nov. 1, 2017) which claims priority to the instant application, dated Aug. 24, 2017, 9 pages.

* cited by examiner

200

200

MULTIBAND WIFI DIRECTIONAL ANTENNAS

FIELD

The present disclosure relates to multiband WiFi directional antennas.

BACKGROUND

This section provides background information related to the present disclosure which is not necessarily prior art.

A common way to provide a dual polarized, dual band antenna assembly is to use separate radiating elements for the low band and the high band. For example, first and second dipoles elements may be respectively used for the low and high bands.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
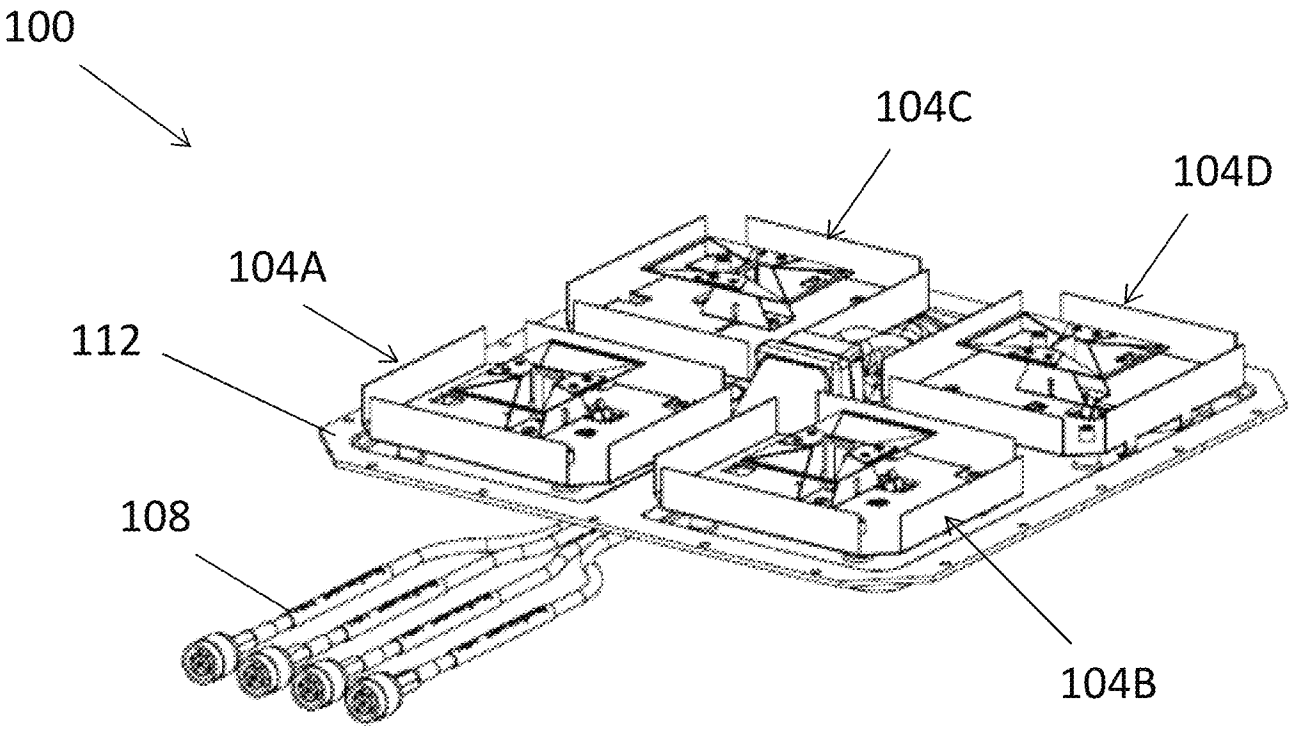
FIG. 1 is a perspective view of a multiband WiFi directional antenna including two vertically polarized antenna element modules or subassemblies, two horizontally polarized antenna element modules or subassemblies, a ground plate, and four cables for the four ports according to an exemplary embodiment.

Example embodiments will now be described more fully with reference to the accompanying drawings.

Disclosed herein are exemplary embodiments of multiband WiFi directional antennas configured to have symmetrical directional beam or similar beamwidths on perpendicular planes. The multiband WiFi directional antenna is configured to be operable within at least a first WiFi frequency range and a second WiFi frequency range different than the first WiFi frequency range. For example, the multiband WiFi directional antenna may be configured for dual band operation from about 2.4 Gigahertz (GHz) to about 2.5 GHz and from about 5.15 GHz to about 5.9 GHz. Alternatively, the multiband WiFi directional antenna may be configured to be operable in more or less than two frequency ranges or bands (e.g., broadband (wideband) covering several bands, etc.) and/or in one or more other frequency ranges or bands (e.g., one or more non-WiFi frequency ranges, etc.).

In an exemplary embodiment, an antenna includes four radiating elements or radiators on top of a dielectric (e.g., plastic, etc.) base plate (broadly, a base or support member). Two of the radiating elements are vertically polarized, while the other two radiating elements are horizontally polarized. Each radiating element is connected with a cable (broadly, a feed) such that there are four cables each connected to a corresponding one of the four radiating elements.

A radome or housing is positioned over the radiating elements and coupled (e.g., mechanically fastened with screws, etc.) to the base plate. The radiating elements are disposed within an interior collectively defined by and generally between the radome and the base plate such that the radiating elements are protected from and not exposed to the environment (e.g., dirt, dust, water, etc.). For example, the antenna may be configured to satisfy the IP67 ingress protection standard where 6 indicates total protection against solid objects/dust and 7 indicates protection against liquids up to and including the effects of immersion in 15 centimeters to 1 meter of liquid.

Each radiating element includes first and second (or upper and lower) electrically-conductive (e.g., metal or metallic, etc.) parts coupled (e.g., mechanically fastened by rivets, etc.) together. The second or lower part of the radiating element is coupled (e.g., mechanically fastened by pems, etc.) to an electrically-conductive (e.g., aluminum, etc.) ground plane or reflector.

A feeding board (broadly, a feed element) is within an interior area or space defined between portions of the radiating element. The feeding board is used to excite the radiating element. The feeding board is inserted into a slot defined by the ground plane/reflector such that first and second (or upper and lower) portions of the feeding board are along opposite upper and lower (or top and bottom) surfaces of the ground plane or reflector. The radiating element may then be positioned relative to (e.g., lowered downward onto, etc.) the feeding board and ground plane/reflector such that the upper portion of the feeding board is inserted through a slot in the lower or second part of the radiating element. The radiating element may then be coupled to the ground plane/reflector. Alternatively, the radiating element may be coupled to the ground plane/reflector before the feeding board is inserted into the slot of the ground plane or reflector. Then, the lower portion of the feeding board may be inserted into the aligned slots of the radiating element and the ground plane/reflector after the radiating element is positioned on and coupled to the ground plane/reflector. In either case, the positioning of the feeding board within the slots of the radiating element and the ground plane/reflector may help retain (e.g., via a friction fit or interference fit, etc.) the feeding board in place relative to the radiating element and the ground plane/reflector.

A cable (e.g., coaxial cable, other transmission line, etc.) is electrically connected (e.g., using a feed-through, etc.) to a back side of the lower portion of the feeding board. The front side of the lower portion of the feeding board includes a resistive network along the feeding board (e.g., resistors soldered to the feeding board and/or placed directly on via surface mount technology (SMT), etc.) RF energy enters through the cable and travels in a microstrip line (broadly, transmission line) along the front side of the feeding board. The RF energy excites an electric field in the top of the radiating element.

The sidewalls and bottom portion of the ground plane/reflector may be operable for reflecting and/or directing signals from the radiating element in a same general direction such that the radiating element radiates a symmetrical directional beam in a direction generally perpendicular and away from the ground plane/reflector at a first WiFi frequency range (e.g., from about 2.4 GHz to about 2.5 GHz) and a second WiFi frequency range (e.g., from about 5.15 GHz to about 5.9 GHz, etc.). The combination of the four radiating elements or radiators forms a MIMO access point with space and polarization diversity.

With reference now to the figures, FIG. 1 illustrates an example antenna 100 embodying one or more aspects of the present disclosure. As shown, the antenna 100 includes four antenna element modules or subassemblies 104. Two antenna element modules 104A, 104B are vertically polarized, while the other two antenna element modules 104C, 104D are horizontally polarized.

Each antenna element module 104 is connected with a cable 108 (broadly, a feed) such that there are four cables 108 each connected to a corresponding one of the four antenna element modules 104. The antenna element modules 104 are positioned on top of a dielectric base plate 112 (broadly, a base or support member). The base plate 112 may be made from various dielectric or electrically non-conductive materials, such as plastic, etc.

In this particular example, the vertically polarized antenna element modules 104A, 104B are located towards a top of the antenna 100 or closest to the cables 108, while the horizontally polarized antenna element modules 104C, 104D are located towards a top of the antenna 100. Alternatively, the antenna element modules 104 may be arranged differently. For example, another exemplary embodiment may have the horizontally polarized antenna element modules 104C, 104D located towards a bottom of the antenna 100 or closest to the cables 108, while the vertically polarized antenna element modules 104A, 104B are located towards a top of the antenna 100. Other exemplary embodiments may have one horizontally polarized antenna element module 104C or 104D and one vertically polarized antenna element module 104A or 104B located towards a bottom of the antenna 100 or closest to the cables 108, while the other horizontally polarized antenna element module and other vertically polarized antenna element module are located towards a top of the antenna 100.

Figure 2:
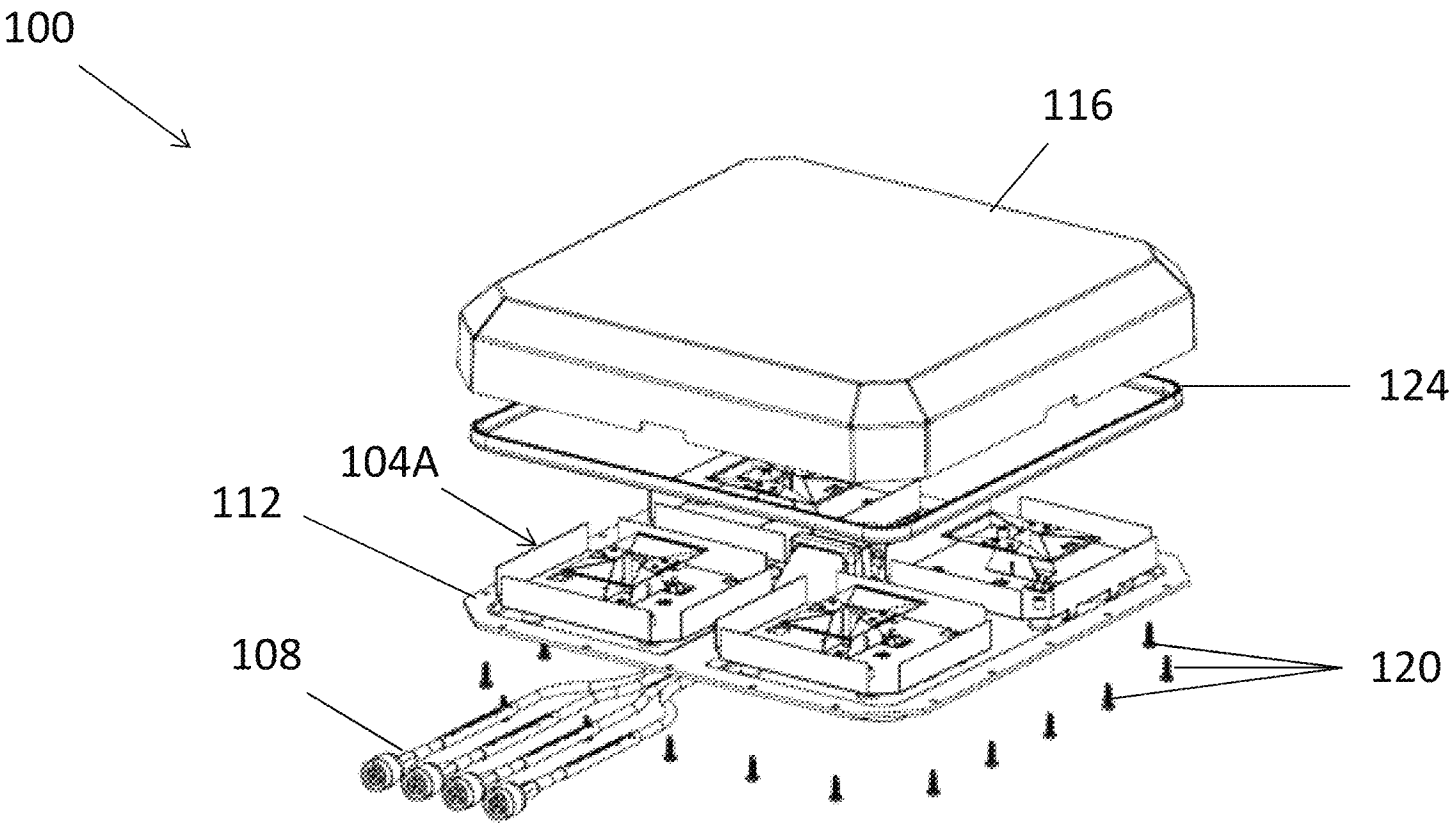
FIG. 2 is an exploded perspective view of the antenna shown in FIG. 1 and also illustrating an exemplary radome or housing, a sealing member, and fasteners for attaching the radome to the ground plate according to an exemplary embodiment.

As shown in FIG. 2, a radome or housing 116 may be positioned over the antenna element modules 104. The radome 116 may be coupled to the base plate 112, such as by using mechanical fasteners, adhesives, etc. For example, FIG. 2 shows screws 120 that may be positioned through holes in the base plate 112 and then threadedly engaged with threaded openings or portions underneath the radome 116. The radome 116 may be made out of polycarbonate plastic, acrylonitrile styrene acrylate (ASA), acrylonitrile butadiene styrene (ABS), a blend, among other suitable plastics, thermoplastics, and materials, etc.

A seal or sealing member 124 (e.g., an O-ring having a U-shaped profile, elastomeric sealing member, a rubber sealing member, a thermoplastic elastomer sealing member, etc.) may be disposed between the radome 116 and the base plate 112 to help seal the interior collectively defined by and generally between the radome 116 and the base plate 112, such that the antenna element modules 104 are protected from and not exposed to the environment (e.g., dirt, dust, water, etc.). For example, the antenna 100 may be configured to satisfy the IP67 ingress protection standard where 6 indicates total protection against solid objects/dust and 7 indicates protection against liquids up to and including the effects of immersion in 15 centimeters to 1 meter of liquid.

Figure 3:
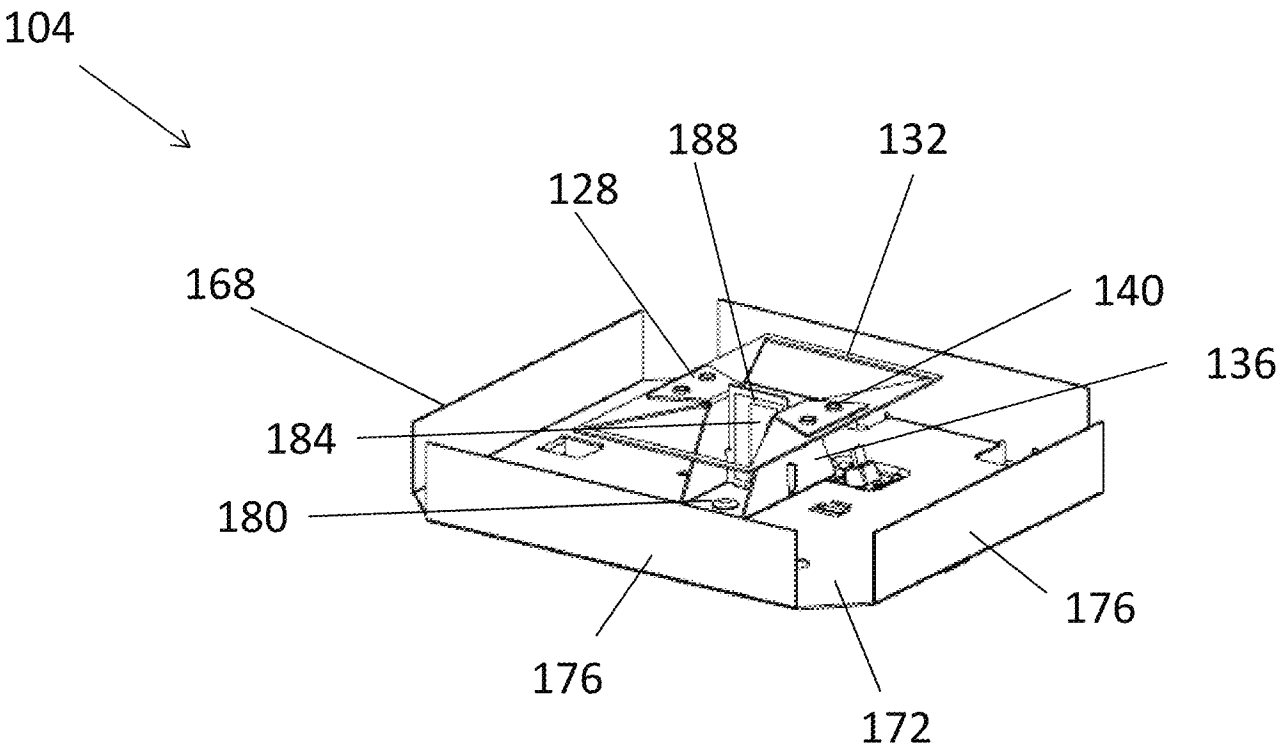
FIG. 3 is a perspective view of one of the four antenna element modules shown in FIG. 1, and showing a feeding board, a ground plane or reflector and radiating element according to an exemplary embodiment.
Figure 4:
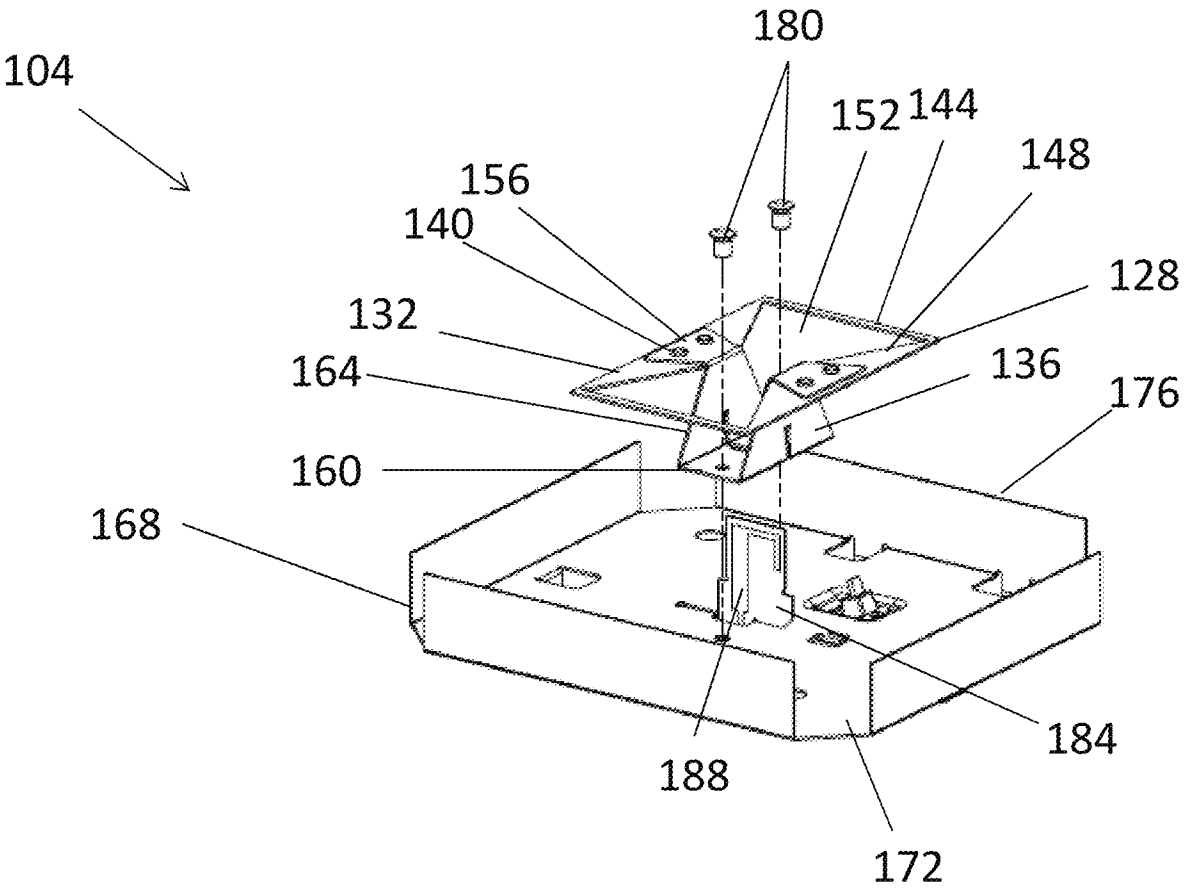
FIG. 4 is an exploded perspective view of the antenna element module shown in FIG. 3, and showing the feeding board including a feeding microstrip line, the ground plane or reflector, the radiating element including a slot for receiving the feeding board, and pems for mounting the radiating element to the ground plane or reflector.

As shown in FIGS. 3 and 4, each antenna element module 104 includes a radiating element or radiator 128. The radiating element 128 includes a first or upper electrically-conductive part or portion 132 and a second or lower electrically-conductive part or portion 136. In this exemplary embodiment, the first and second electrically-conductive parts 132, 136 are separate and discrete metal or metallic parts that are coupled together by rivets 140. The first and second electrically-conductive parts 132, 136 may be made from any suitable electrically-conductive materials, such as aluminum, brass, tin-plated steels, other metals, alloys, non-metals, etc. Also, the first and second electrically-conductive parts 132, 136 may be coupled together using other means besides rivets, such as other mechanical fasteners, welding, adhesives, etc. In other exemplary embodiments, the first and second parts 132, 136 of the radiating element 128 may be formed integrally with each other (e.g., by stamping and folding metal, etc.).

As shown in FIG. 4, the first or upper part 132 of the radiating element 128 has a generally rectangular outer perimeter 144 and first and second portions 148 (e.g., trapezoidal shaped portions, etc.) extending inwardly from a corresponding one of the two longer sides of the generally rectangular outer perimeter. The first and second portions 148 are opposed and extend inwardly towards each other without making contact, such that the first or upper part 132 is annular with an opening 152 (e.g., hourglass shaped opening, bowtie shaped opening, etc.). Alternatively, the first part 132 of the radiating element 128 may be configured differently, such as with different shapes, etc.

The second or lower part 136 of the radiating element 128 includes first and second end portions 156 (e.g., trapezoid shaped end portions, etc.) that are respectively coupled (e.g., mechanically fastened by rivets 140, etc.) to the corresponding first and second portions 148 of the first or upper part 132 of the radiating element 128. The second or lower part 136 of the radiating element 128 also includes a middle portion 160 (e.g., rectangular shaped portion, etc.) and first and second connecting portions 164 (e.g., trapezoid shaped portions, etc.) connecting and extending between the middle portion 160 and the corresponding first and second end portions 156. Alternatively, the second part 136 of the radiating element 128 may be configured differently, such as with different shapes, etc.

With continued reference to FIGS. 3 and 4, each antenna element module 104 includes an electrically-conductive ground plane or reflector 168. The ground plane or reflector 168 may also be referred to as a ground plane/reflector or a director. The ground plane/reflector 168 includes a bottom portion 172 and sidewalls 176 that are disposed generally around the radiating element 128. In this example, there are four sidewalls 176 defining a generally square perimeter in which the radiating element 128 is generally centrally located. The ground plane or reflector 168 may be made by stamping aluminum and then folding the stamped aluminum, although other suitable electrically-conductive materials and processes may be used in other embodiments.

The radiating element 128 may be coupled to the ground plane or reflector 168, such as by mechanical fasteners, welding, adhesives, etc. In this exemplary embodiment, pems 180 are inserted through aligned holes in the middle portion 160 of the second part 136 of the radiating element 128 and the bottom portion 172 of the ground plane or reflector 168, to thereby couple the radiating element 128 to the ground plane or reflector 168.

Each antenna element module 104 further includes a feeding board 184 (broadly, a feed element). The feeding board 184 includes a microstrip line 188 (broadly, transmission line) along a first side of the feeding board 184. The feeding board 184 is positioned within an interior area or hollow center portion defined between portions of the radiating element 128 as shown in FIG. 3. The feeding board 184 is used to excite the radiating element 128 as disclosed herein.

Figure 5:
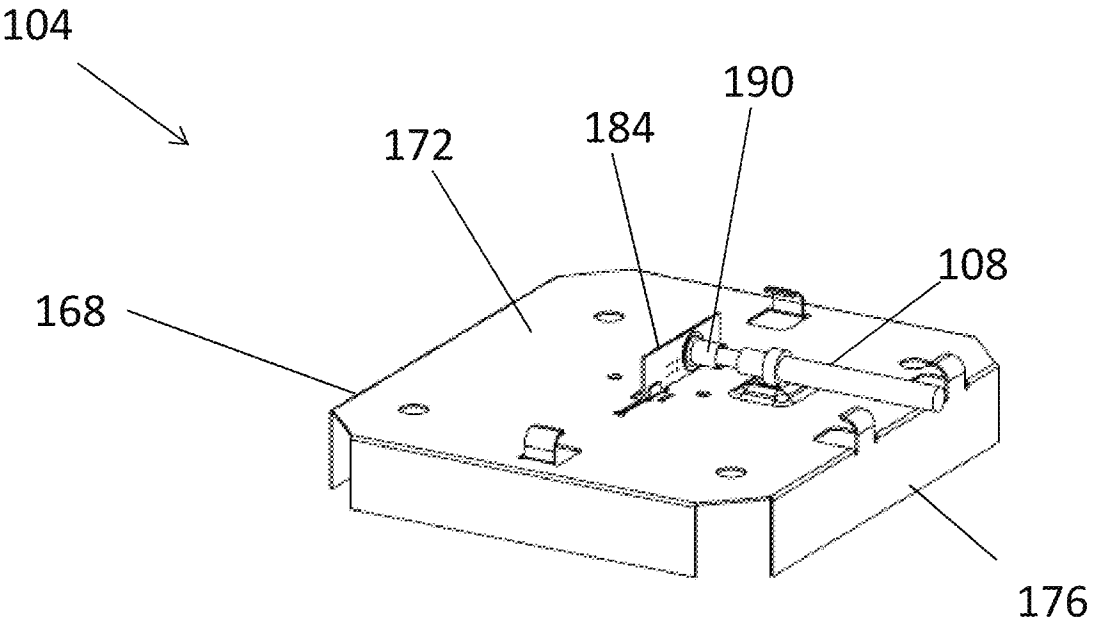
FIG. 5 is a bottom perspective view of the antenna element module shown in FIG. 3, and showing a bottom of the feeding board extending outwardly from and through the bottom of the ground plane or reflector and a coaxial cable connected to the feeding board.

The feeding board 184 may first be inserted into a slot defined by the bottom portion 172 of the ground plane or reflector 168 such that first and second (or upper and lower) portions of the feeding board 184 are on opposite upper and lower (or top and bottom) surfaces of the bottom portion 172 of the ground plane or reflector 168 as shown by a comparison of FIGS. 4 and 5. The radiating element 128 may then be positioned relative to (e.g., lowered downward onto, etc.) the feeding board 184 such that the upper portion of the feeding board 184 is inserted through a slot in the second part 136 of the radiating element 128. The radiating element 128 may then be coupled to the ground plane or reflector 168, e.g., using pems 180, etc. Alternatively, the radiating element 128 may first be coupled to the ground plane or reflector 168 before the feeding board 184 is inserted into the slot of the ground plane or reflector 168. Then, the lower portion of the feeding board 184 may be inserted into the aligned slots of the radiating element 128 and the ground plane or reflector 168. In either case, the positioning of the feeding board 184 within the slots of the radiating element 128 and the ground plane or reflector 168 may help retain (e.g., via a friction fit or interference fit, etc.) the feeding board 184 in place.

Figure 6:
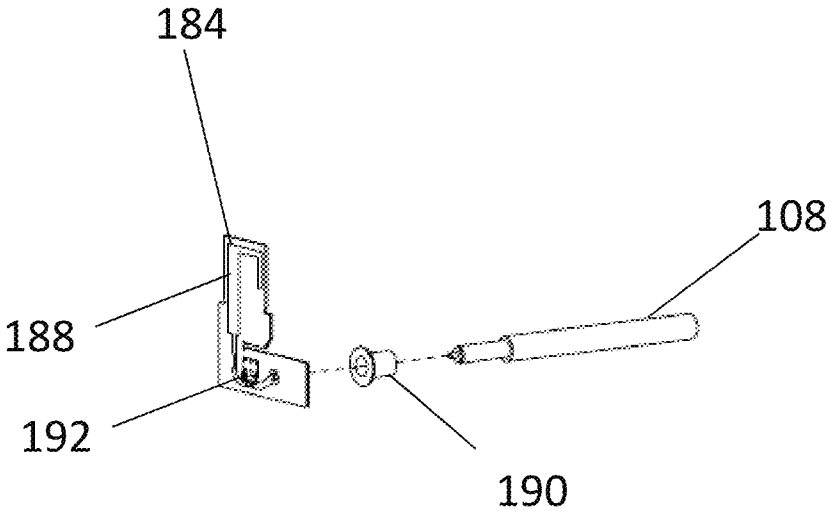
FIG. 6 is an exploded perspective view showing the feeding board including a resistive network, the feedthrough, and the coaxial cable shown in FIG. 5.

As shown in FIGS. 5 and 6, the cable 108 (e.g., coaxial cable, other transmission line, etc.) may be electrically connected to the feeding board 184 using a feed-through 190 (e.g., coaxial cable feed-through bushing, etc.). The feeding board 184 includes a resistive network 192 (FIG. 6) on a side of the feeding board 184 opposite the feed-through 190. The resistive network 192 may include one or more resistors soldered to the feeding board 184 and/or placed directly on the feeding board 184 via surface mount technology (SMT), etc.

During operation, RF energy enters through the cable 108 and travels in the microstrip line 188 to excite an electric field in the top of radiating element 128. In this exemplary embodiment, each radiating element 128 radiates a symmetrical directional beam in a direction generally perpendicular and away from the bottom portion 172 of the ground plane or reflector 168 at a first WiFi frequency range from about 2.4 GHz to about 2.5 GHz and a second WiFi frequency range from about 5.15 GHz to about 5.9 GHz, etc. The combination of the four antenna element modules 104 and their radiating elements or radiators 128 may be used to form a MIMO access point with space and polarization diversity.

FIGS. 7 through 14 illustrate another exemplary embodiment of an antenna 200 that may include similar or identical components as the antenna 100. For example, the antenna 200 may also include four antenna element modules or subassemblies 104 as shown in FIGS. 1 through 6 and described above.

Figure 7:
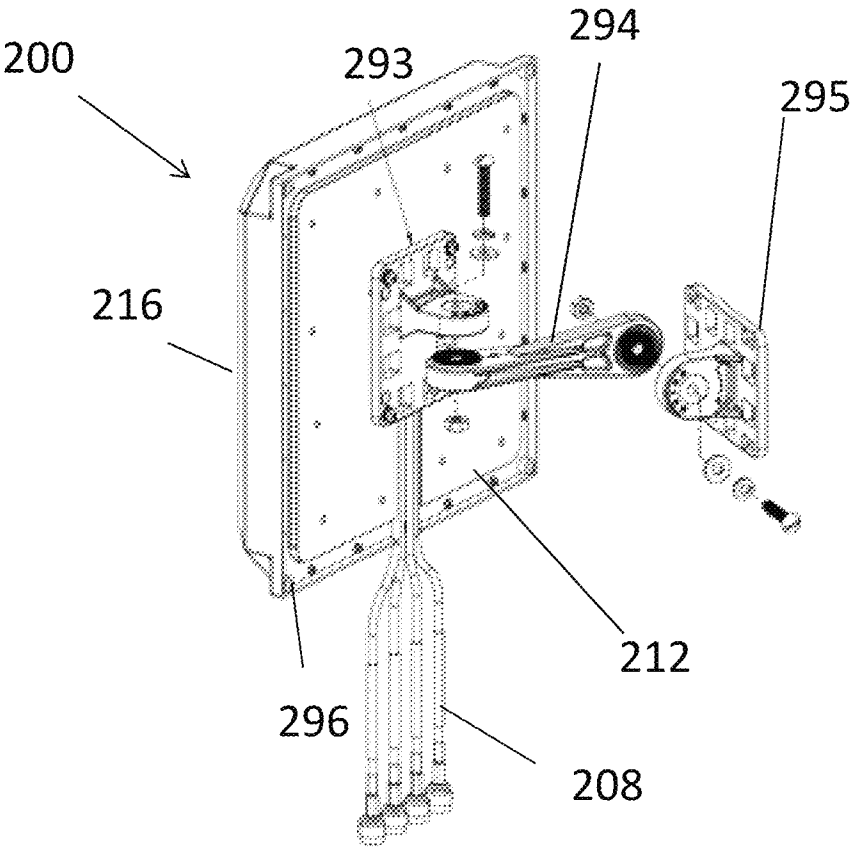
FIGS. 7 and 8 are rear perspective views of another exemplary embodiment of a multiband WiFi directional antenna including two vertically polarized antenna element modules or subassemblies and two horizontally polarized antenna element modules, and also showing an exemplary radome and exemplary components (e.g., mounting bracket, flange mount, and mounting arm, etc.) for mounting the antenna.
Figure 8:
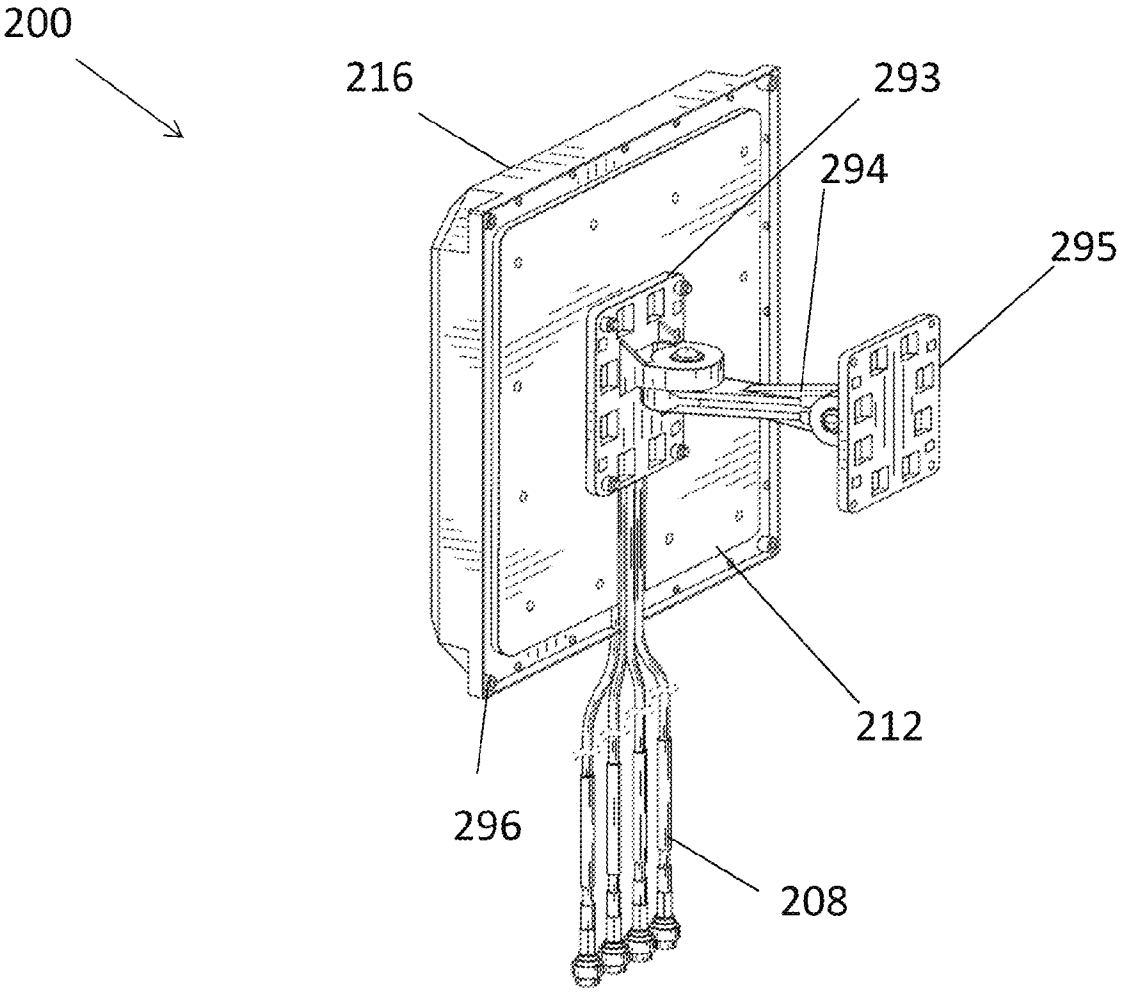
Figure 17:
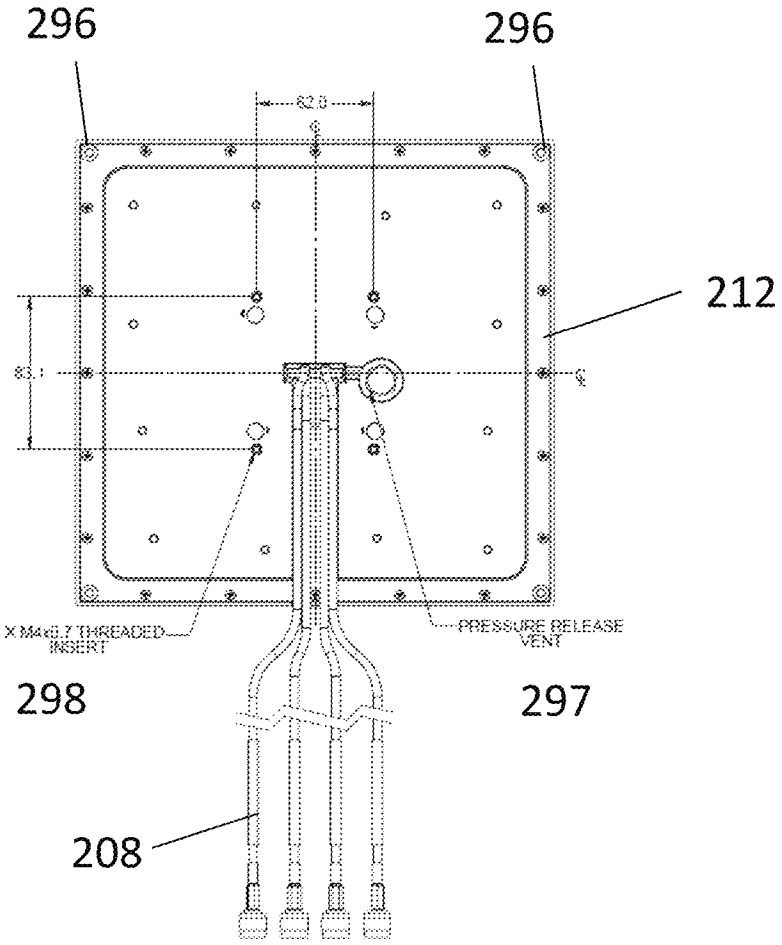
FIG. 17 is a back elevation view of the antenna shown in FIG. 7 without the mounting bracket, flange mount, and mounting arm, where the exemplary dimensions (in millimeters) are provided for purposes of illustration only according to an exemplary embodiment.

FIGS. 7 through 14 illustrate an exemplary radome 216 and exemplary components that may be used for mounting the antenna 200. As shown in FIGS. 7 and 8, a flange mount 293 may be installed (e.g., mechanically fastened using screws, etc.) to the back side of the base plate 212, which may include threaded inserts 298 (FIG. 17). A first end portion of a mounting arm 294 may be rotatably or pivotably coupled (e.g., mechanically fastened using a screw, nut, and washers, etc.) to the flange mount 293 such that the mounting arm 294 is rotatable or pivotable (e.g., horizontally in FIG. 8, etc.) relative to the antenna 200 and flange mount 293. A second end portion of the mounting arm 294 may be rotatably or pivotably coupled (e.g., mechanically fastened using a screw, nut, and washers, etc.) to a mounting bracket 295 such that the mounting arm 294 is rotatable or pivotable (e.g., vertically in FIG. 8, etc.) relative to the antenna 200 and flange mount 293. The mounting bracket 295 may be coupled (e.g., mechanically fastened, etc.) to a support surface such as a wall, etc. such that the antenna 200 is rotatable, pivotable, or repositionable horizontally and vertically relative to the support surface via the rotatable connections of the mounting arm 294 to the flange mount 293 and mounting bracket 295.

As shown by a comparison of FIGS. 8 and 17, the flange mount 293 may be removable from the base plate 212. FIG. 17 also shows that the base plate 212 may include a pressure release vent 297 and threaded inserts 298.

Figure 9:
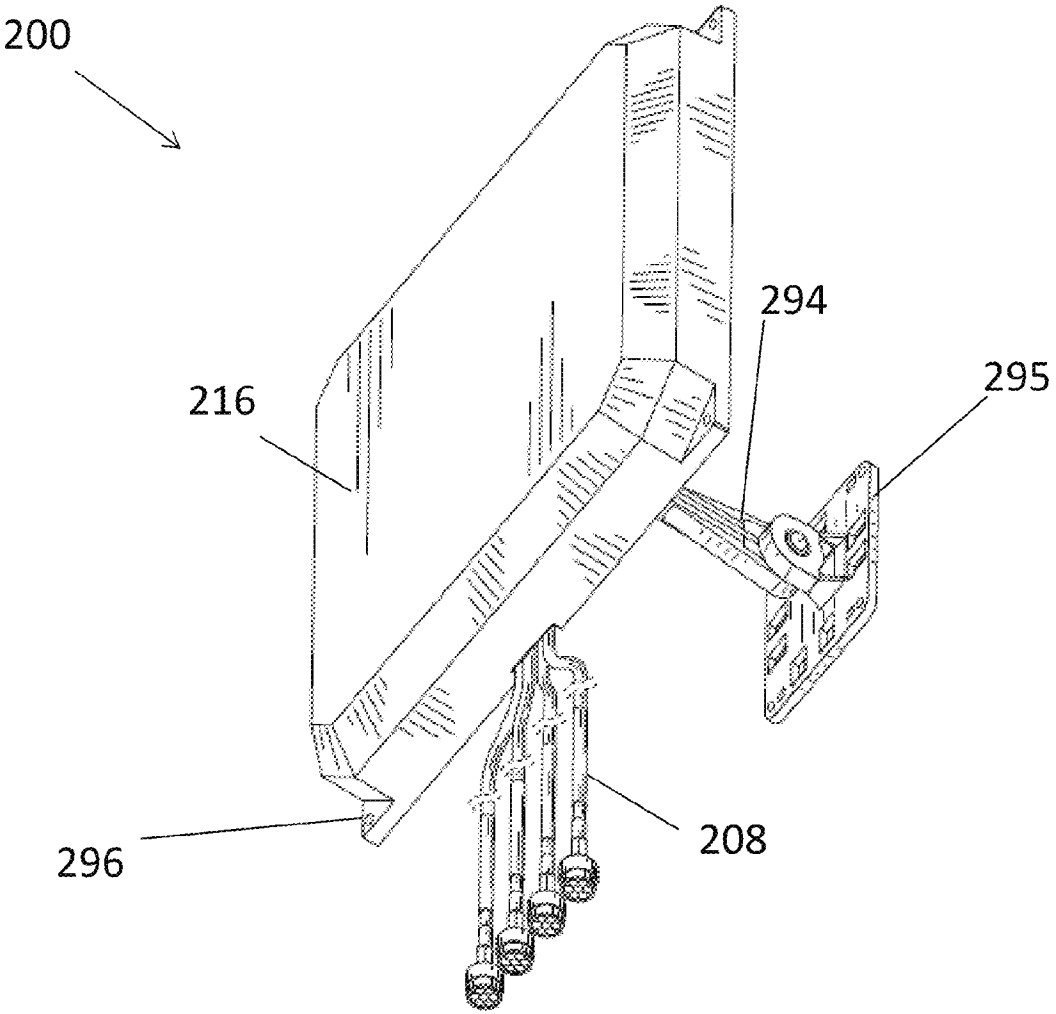
FIG. 9 is a front perspective view of the antenna shown in FIG. 8.
Figure 10:
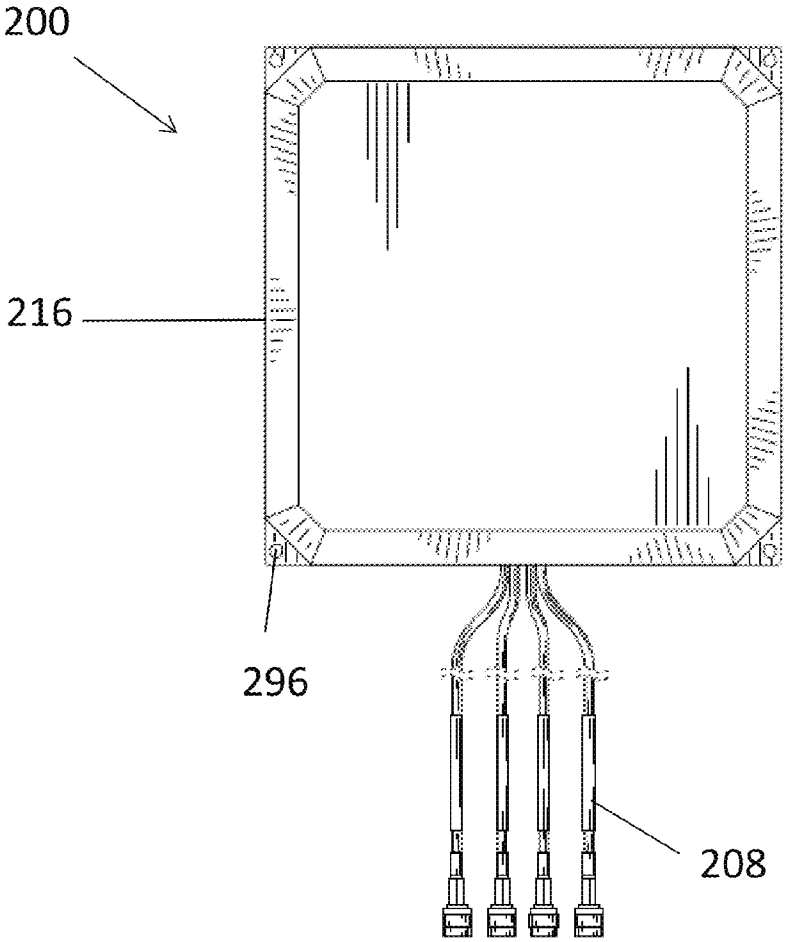
FIG. 10 is a front elevation view of the antenna shown in FIG. 9.
Figure 11:
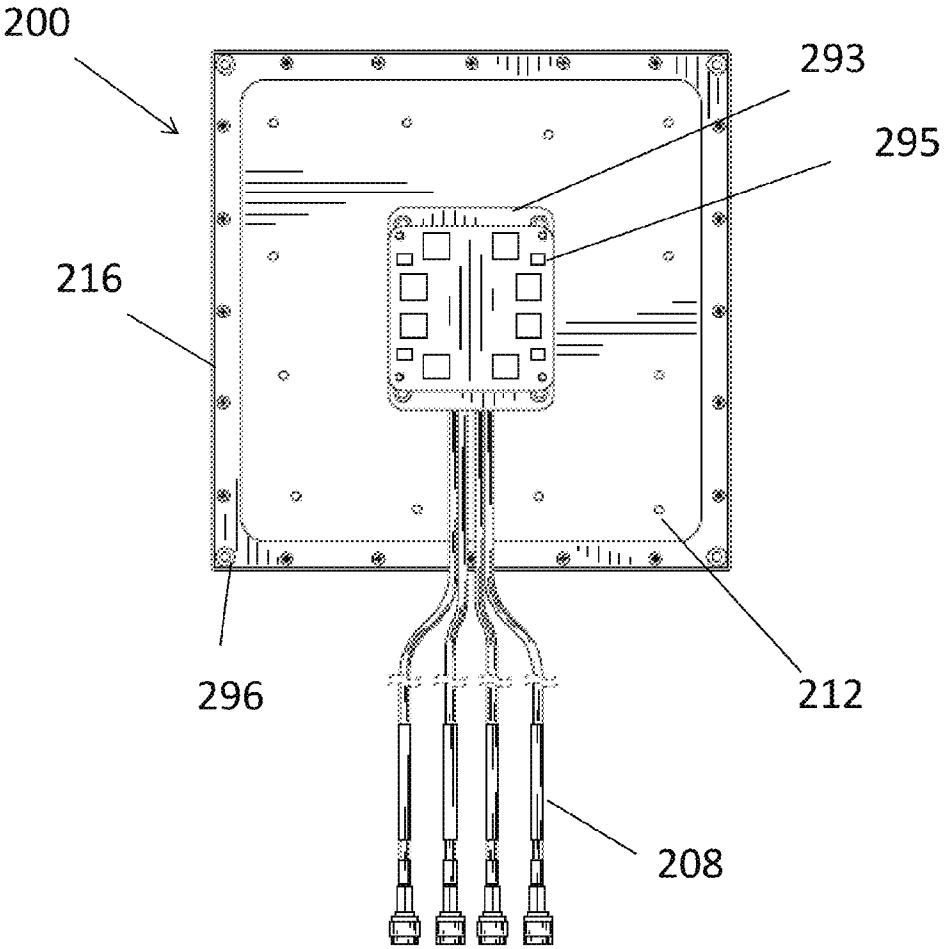
FIG. 11 is a back elevation view of the antenna shown in FIG. 9.
Figure 12:
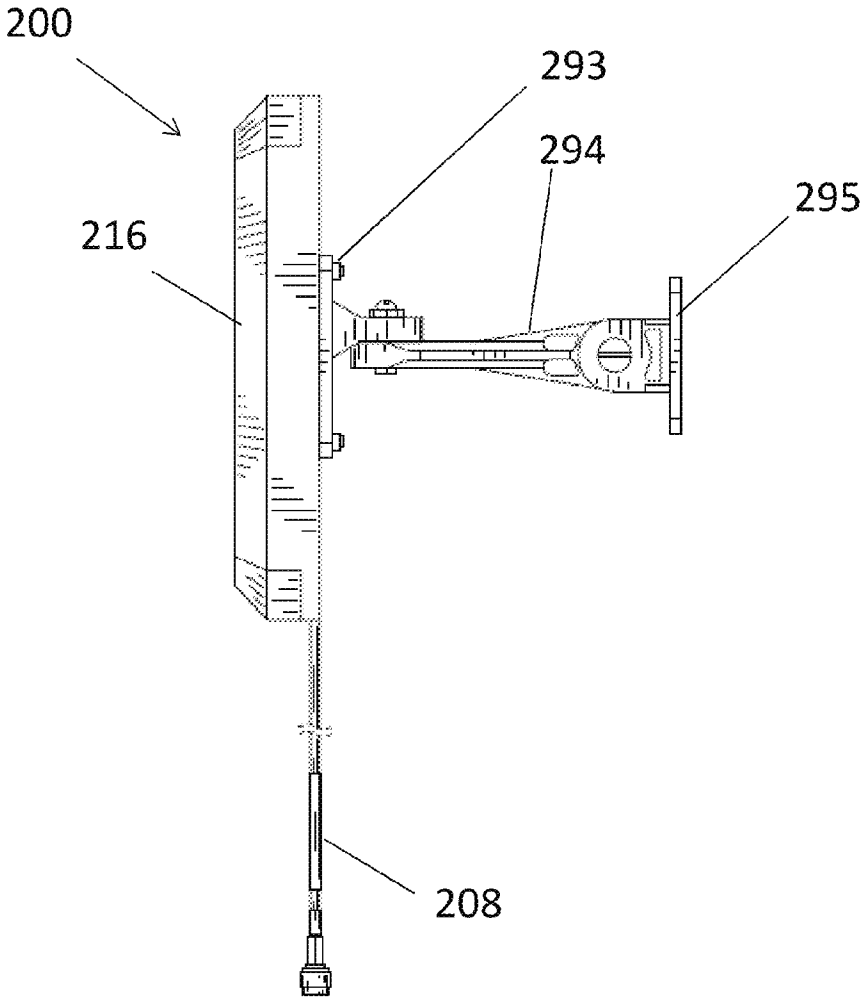
FIG. 12 is a right side elevation view of the antenna shown in FIG. 9.
Figure 13:
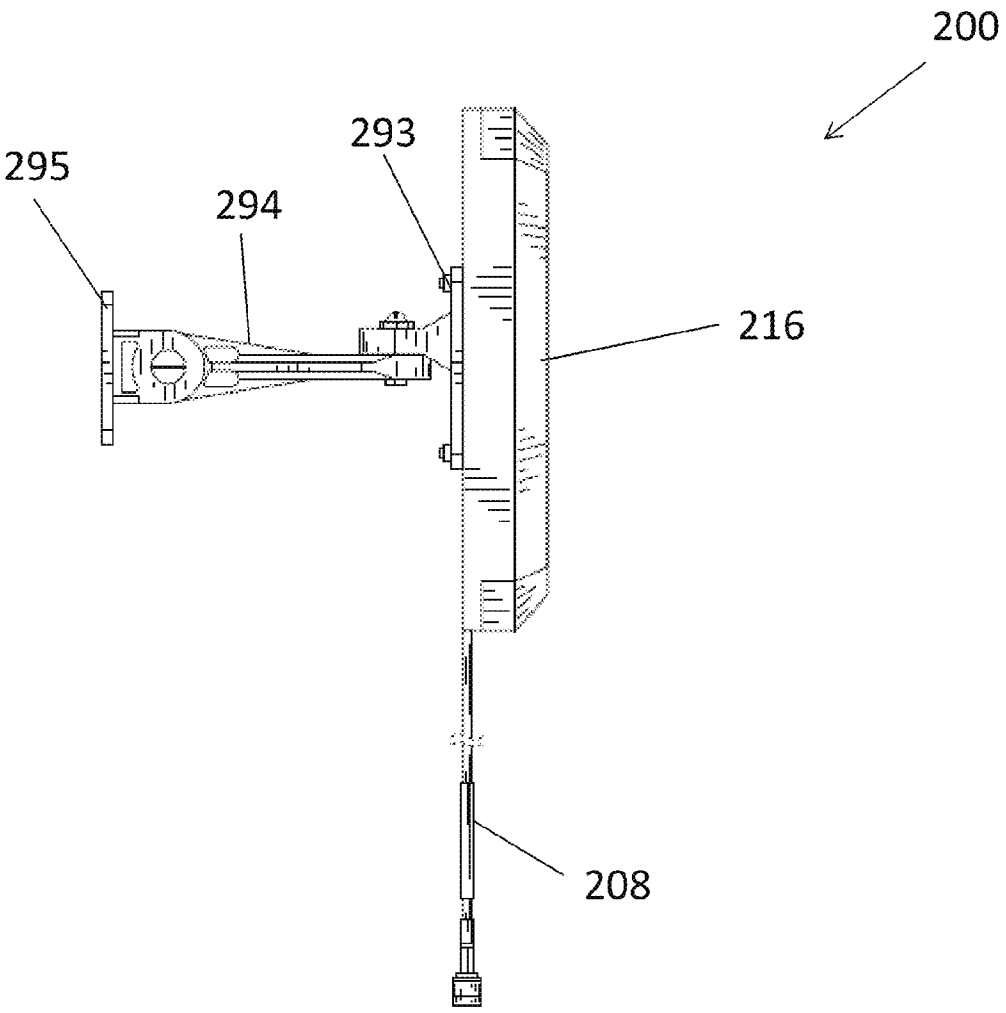
FIG. 13 is a left side elevation view of the antenna shown in FIG. 9.
Figure 14:
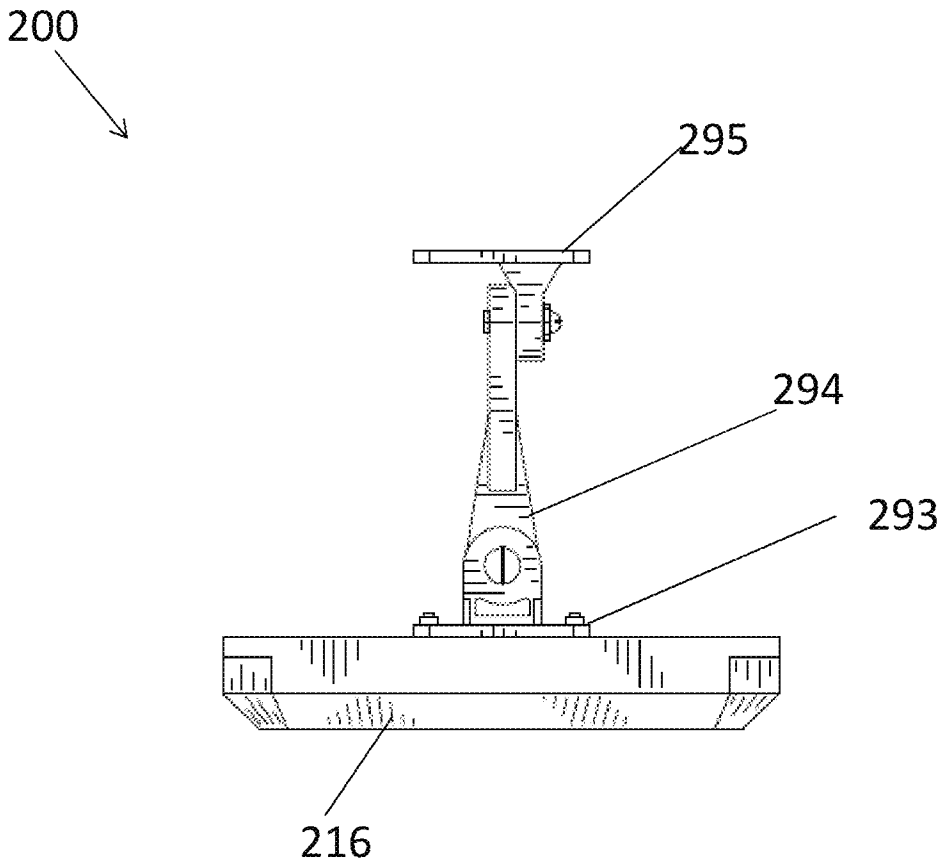
FIG. 14 is a top plan view of the of the antenna shown in FIG. 9.
Figure 15:
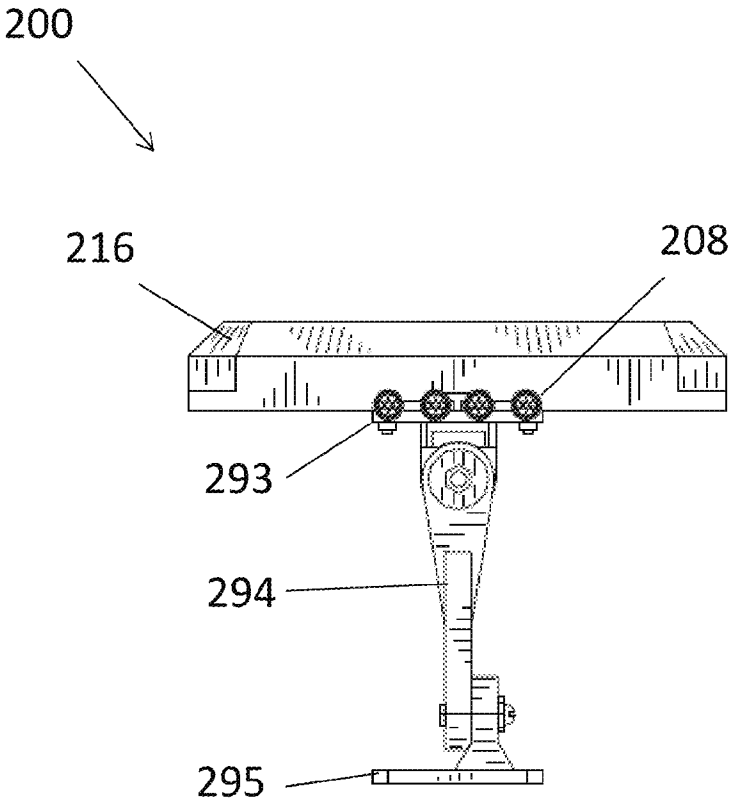
FIG. 15 is a bottom plan view of the antenna shown in FIG. 9.

As shown in FIGS. 7, 8, and 9, a hole 296 is located at each of the four corners of the radome 216. The holes 296 allow flushing mounting of the antenna 200 to a wall or other support surface. By way of example, the back of the base plate 212 may be positioned flush against a wall. Then, mechanical fasteners may be inserted through the holes 296 and into the wall to thereby mount the antenna 200 to the wall. Accordingly, the exemplary embodiment of the antenna 200 shown in FIGS. 7, 8, 9, and 17 allows for flush mounting to a wall and pole mounting with articulation while allowing the cables 208 to exit the bottom or back.

Figure 16:
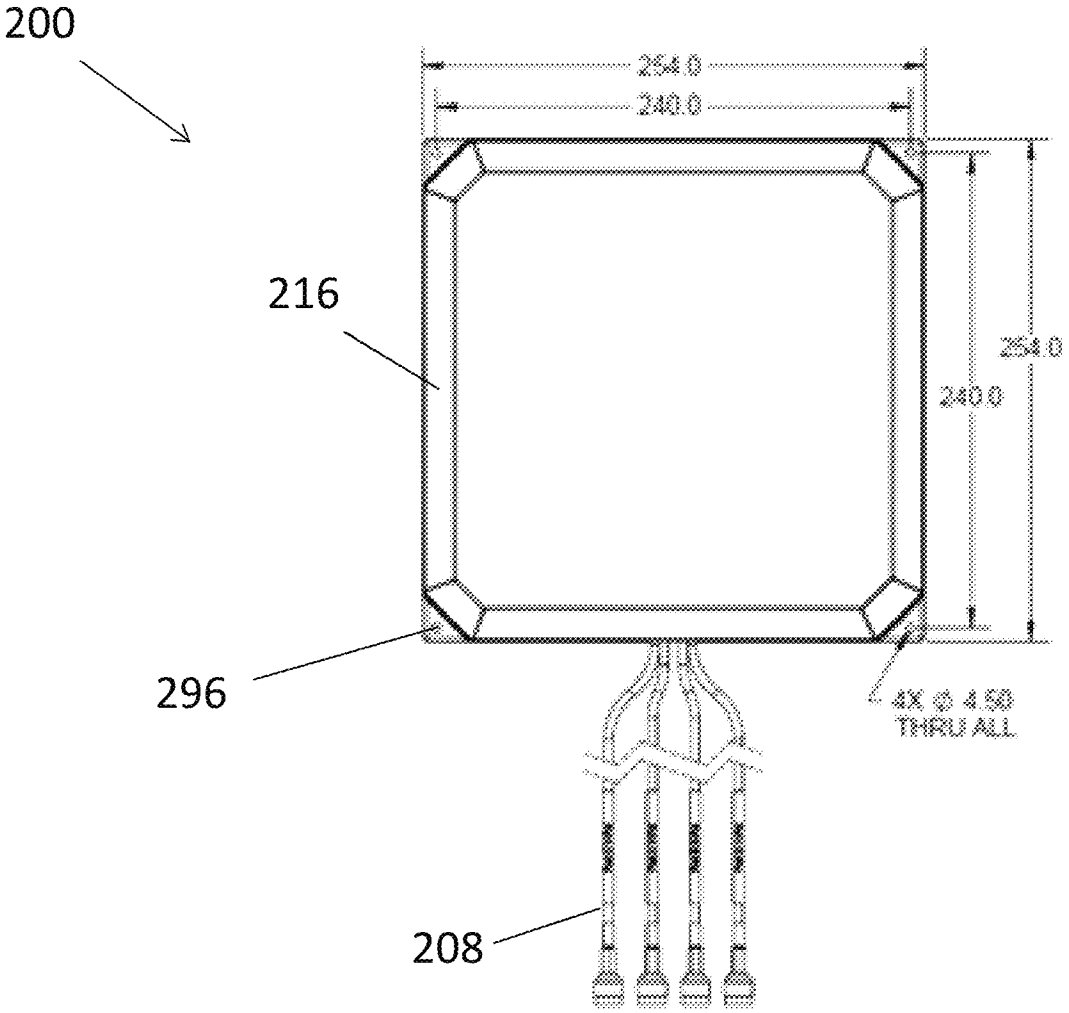
FIG. 16 is a front elevation view of the antenna shown in FIG. 7, where the exemplary dimensions (in millimeters) are provided for purposes of illustration only according to an exemplary embodiment.
Figure 18:
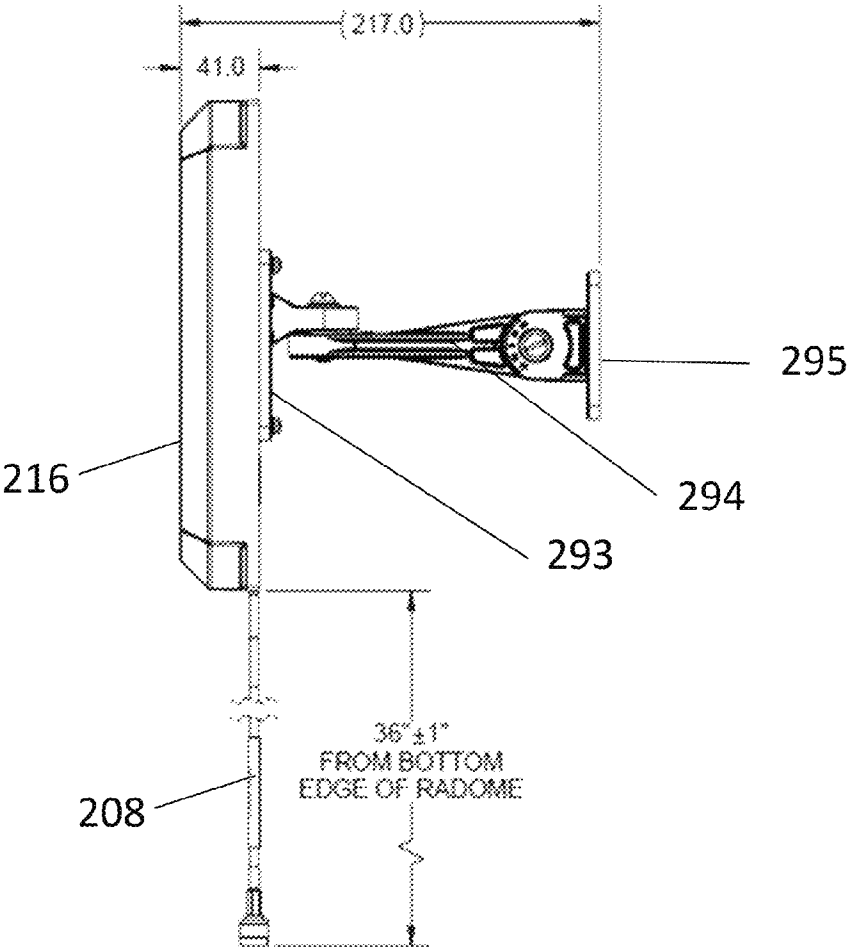
FIG. 18 is a right side elevation view of the antenna shown in FIG. 7, where the exemplary dimensions (in millimeters and inches) are provided for purposes of illustration only according to an exemplary embodiment.

FIGS. 16 through 18 provide exemplary dimensions for purposes of illustration only according to an exemplary embodiment. For example, the base plate 212 and radome 216 when combined may have a square shape that is 254 mm by 254 mm (as shown by FIG. 16) and a thickness of 41 mm (as shown by FIG. 18). Alternative embodiments may be configured differently, such as smaller, larger, and/or with a different shape.

FIGS. 19 through 24 provide test results measured for a prototype of the antenna 100 shown in FIG. 1. These test results are provided only for purposes of illustration and not for purposes of limitation as exemplary embodiments disclosed herein may be configured differently and/or have different performance than what is shown in FIGS. 19 through 24.

Figure 19:
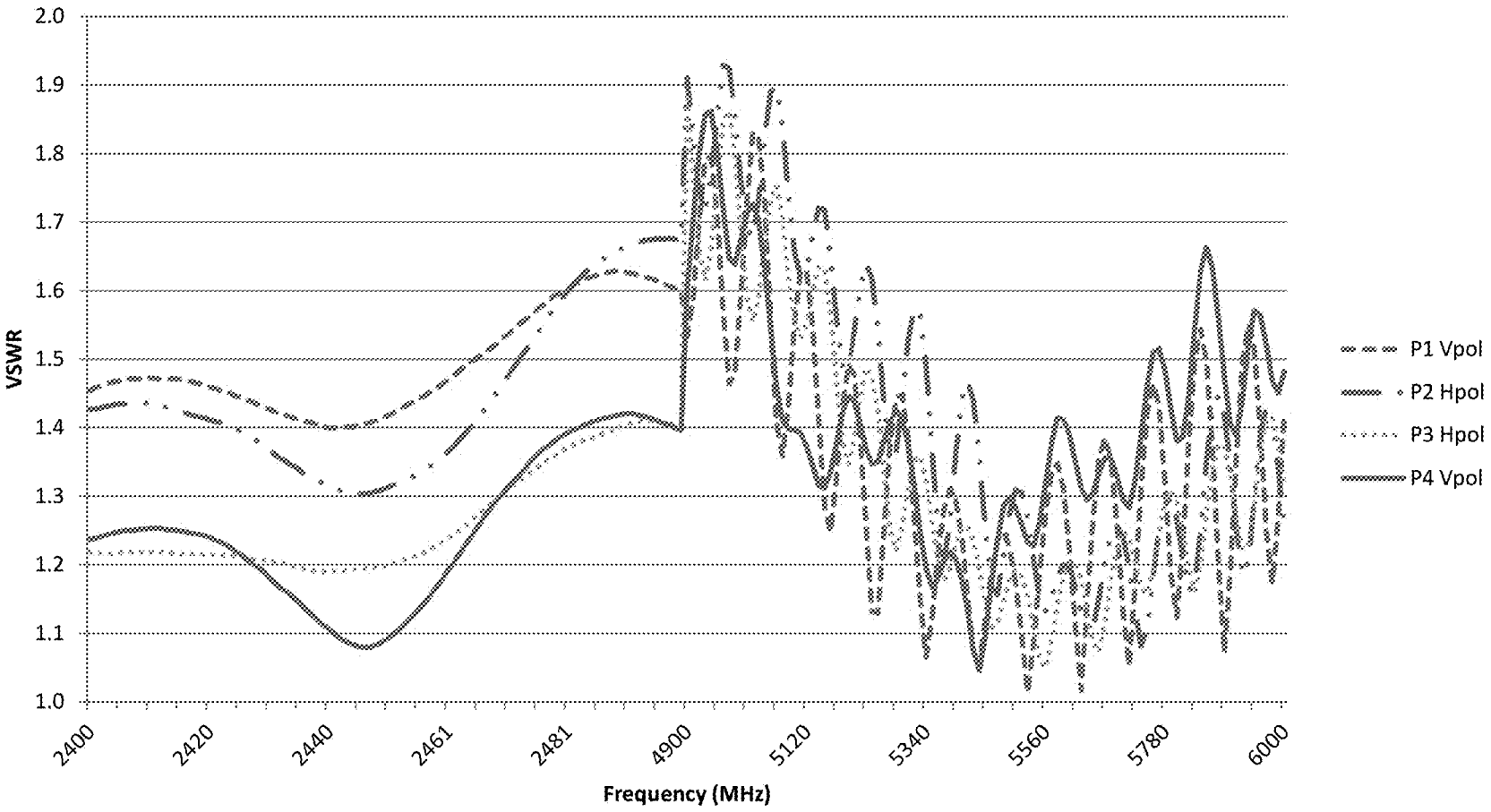
FIG. 19 is an exemplary line graph of voltage standing wave ratio (VSWR) versus frequency in megahertz (MHz) for a prototype of the antenna shown in FIG. 1.

FIG. 19 is an exemplary line graph of voltage standing wave ratio (VSWR) versus frequency in megahertz (MHz) for the prototype of the antenna 100 shown in FIG. 1. Generally, FIG. 19 shows that the two vertically polarized ports and the two horizontally polarized ports of the prototype of the antenna 100 had good VSWR less than 1.5 for frequencies within a first frequency range from 2400 MHz to about 2500 MHz and good VSWR less than about 1.6 for frequencies within a second frequency from about 5150 MHz to about 5900 MHz.

Figure 20:
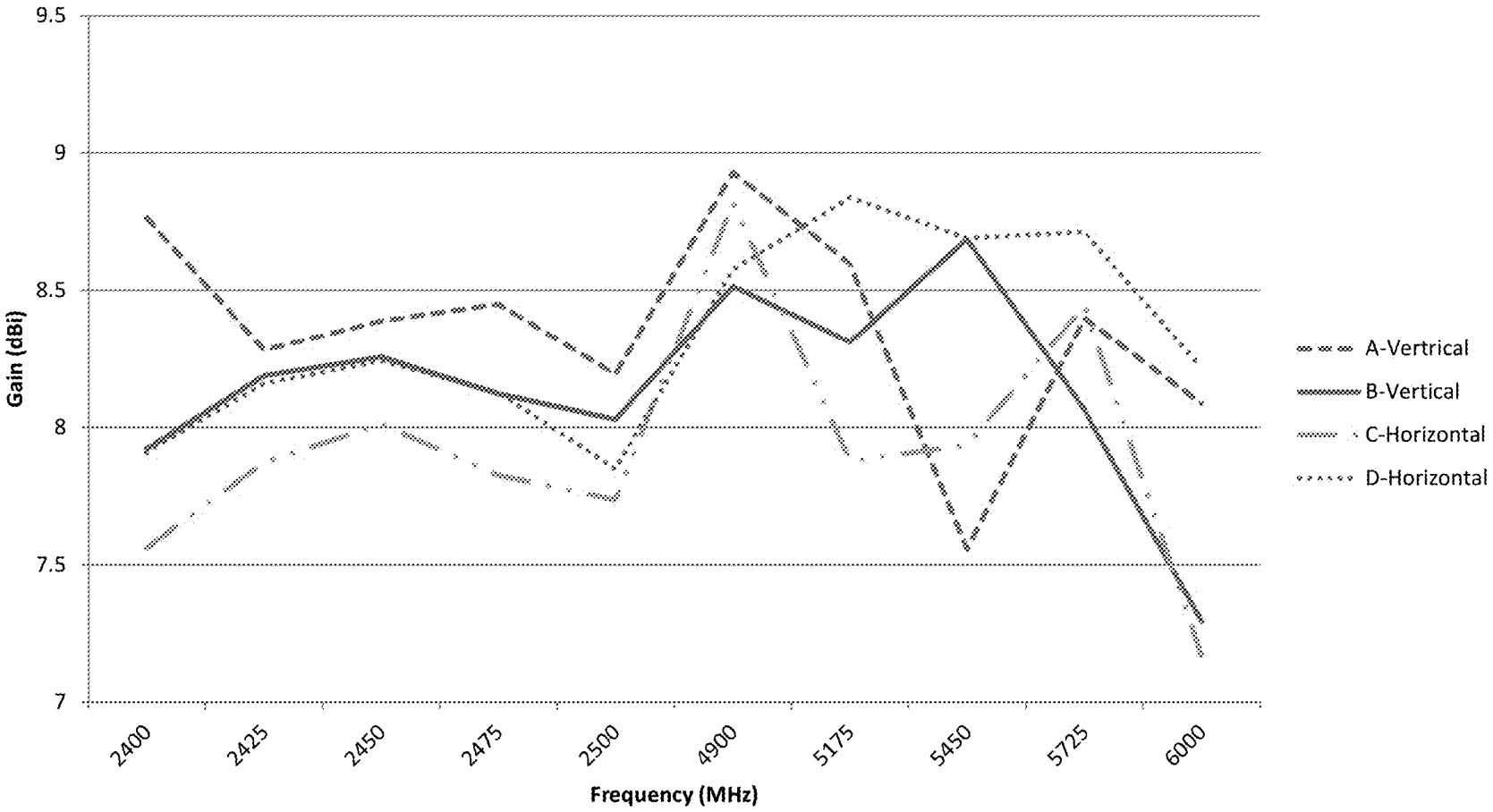
FIG. 20 is an exemplary line graph of gain in decibels relative to isotropic (dBi) versus frequency in megahertz (MHz) for the prototype of the antenna shown in FIG. 1.
Figure 21:
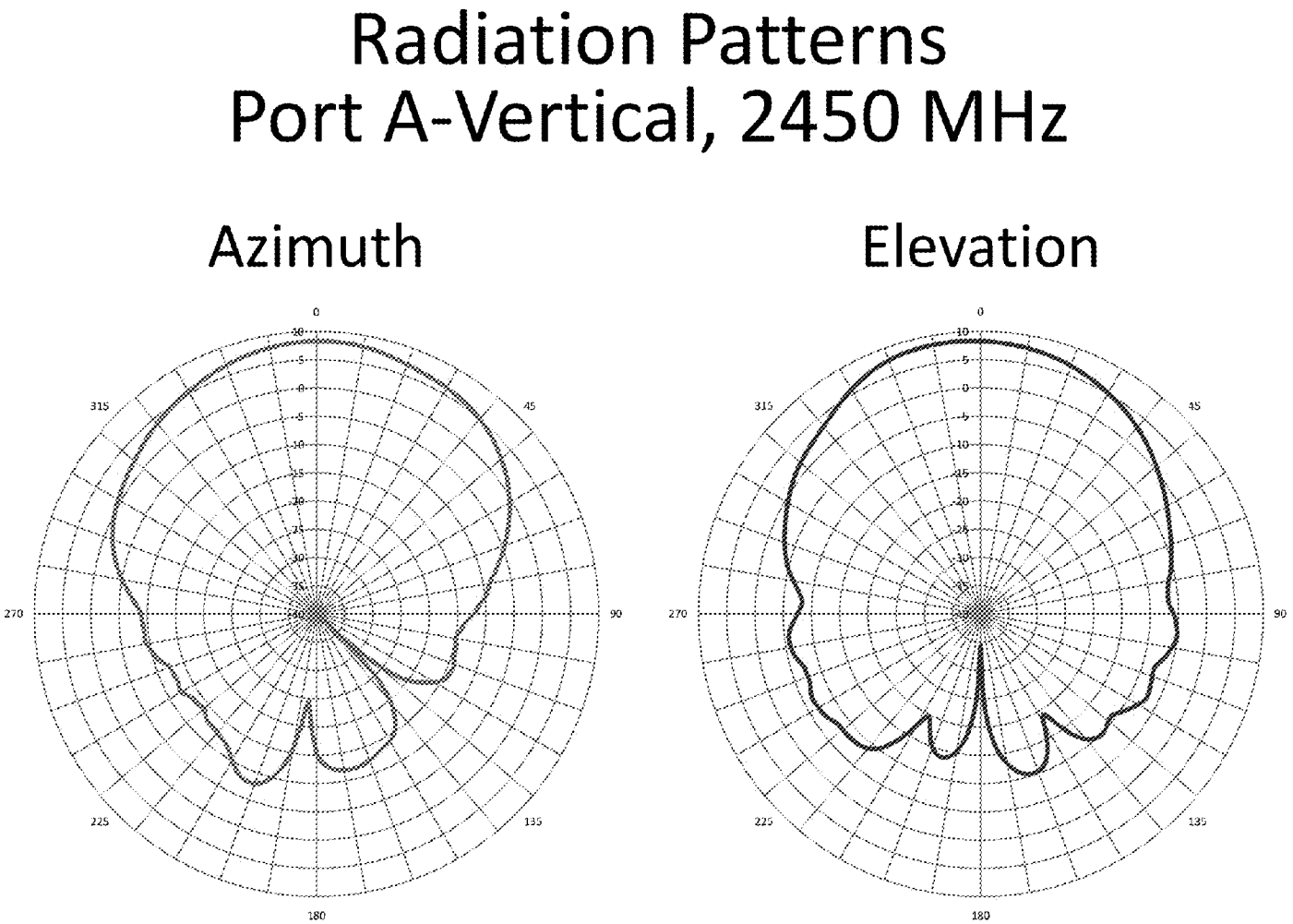
FIG. 21 illustrates radiation patterns (Azimuth and Elevation) measured for a vertically polarized port of the prototype of the antenna shown in FIG. 1 at a frequency of about 2450 MHz.
Figure 22:
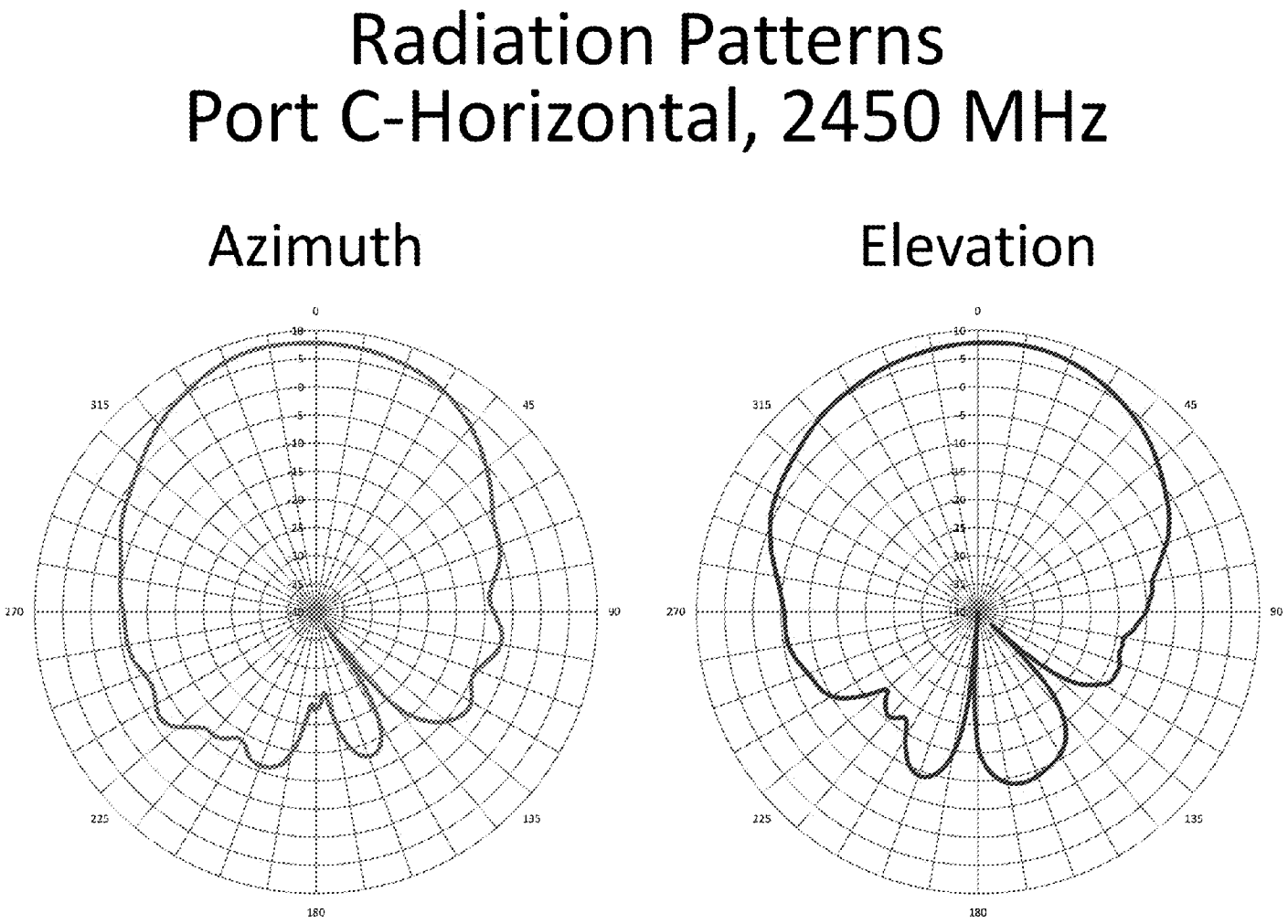
FIG. 22 illustrates radiation patterns (Azimuth and Elevation) measured for a horizontally polarized port of the prototype of the antenna shown in FIG. 1 at a frequency of about 2450 MHz.
Figure 23:
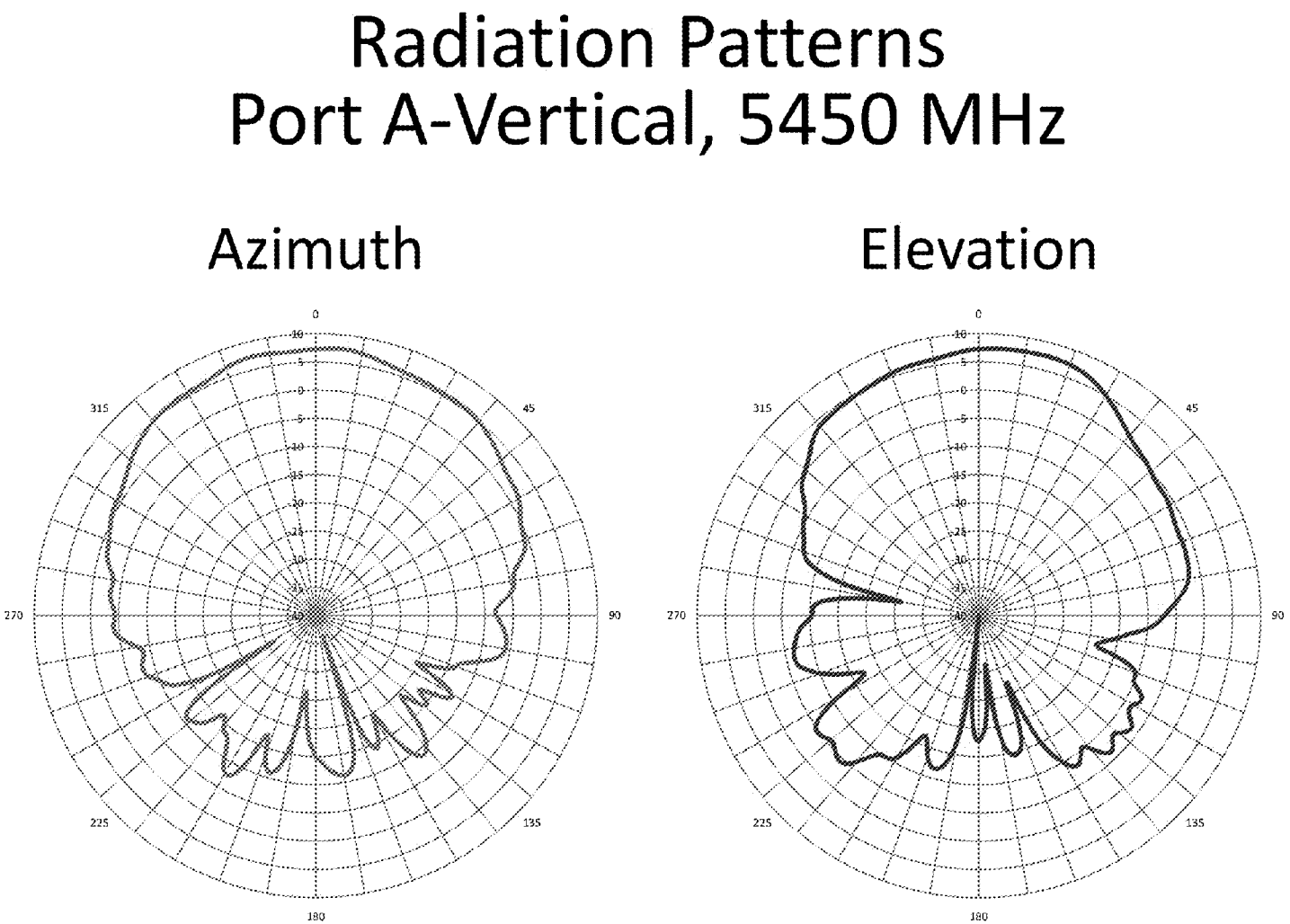
FIG. 23 illustrates radiation patterns (Azimuth and Elevation) measured for a vertically polarized port of the prototype of the antenna shown in FIG. 1 at a frequency of about 5450 MHz.
Figure 24:
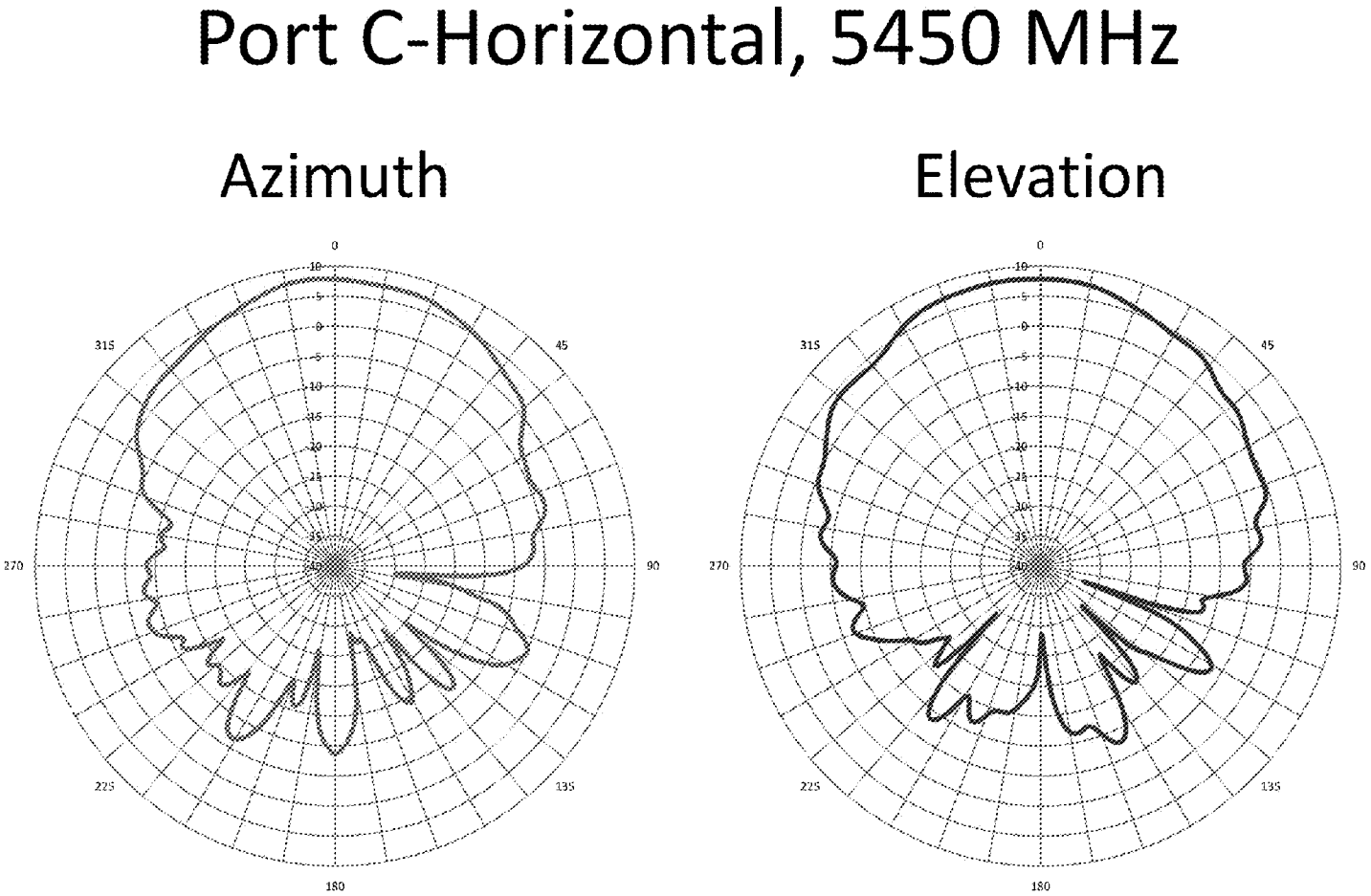
FIG. 24 illustrates radiation patterns (Azimuth and Elevation) measured for a horizontally polarized port of the prototype of the antenna shown in FIG. 1 at a frequency of about 5450 MHz.

FIG. 20 is an exemplary line graph of gain in decibels relative to isotropic (dBi) versus frequency in megahertz (MHz) for the prototype of the antenna 100 shown in FIG. 1. Generally, FIG. 20 shows that the two vertically polarized ports and the two horizontally polarized ports of the prototype of the antenna 100 had good gain (e.g., between about 7.5 dBi and 9 dBi, less than 9 dBi, etc.) for frequencies within a first frequency range from 2400 MHz to about 2500 MHz and for frequencies within a second frequency from about 5150 MHz to about 5900 MHz.

FIGS. 21 through 24 illustrate the radiation patterns (Azimuth and Elevation) measured for a vertically polarized port and a horizontally polarized port of the prototype of the antenna shown in FIG. 1 at frequencies of about 2450 MHz and about 5450 MHz. Generally, FIGS. 21 through 24 show that the radiation patterns of the vertically polarized and horizontally polarized ports are directional at frequencies of 2450 MHz and 5450 MHz.

Exemplary embodiments disclosed herein may provide one or more (but not necessarily any or all) of the following features or advantages over some existing antennas. For example, a multiband WiFi directional antenna disclosed herein may have a relatively low cost construction (e.g., may not require a network board, etc.), may be relatively easy to manufacture, and/or may have a compact size as compared to some other conventional WiFi directional antennas. As another example, a multiband WiFi directional antenna disclosed herein may be used as one of several antennas in a panel antenna or as part of a multiple input multiple output (MIMO) antenna system. A multiband WiFi directional antenna disclosed herein may be configured for dual band operation with about a 9 dBi (decibels relative to isotropic) gain and/or with a symmetrical beam for each band (e.g., about 65 degrees by 65 degrees, etc.) and/or provide the ability to reduce gain to below 6 dBi for compliance. A multiband WiFi directional antenna disclosed herein may be configured to have symmetrical and consistent beam over wideband frequencies while keeping material cost very low and/or provide the ability to adjust gain for both bands to meet compliance. A multiband WiFi directional antenna disclosed herein may be configured to have radiation patterns that are relatively narrow at the principle E-plane and H-plane. By comparison, a conventional dual band dipole directive antenna has a radiation pattern that is wide at one of the principal planes, i.e., the H-plane.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna operable within at least a first WiFi frequency range and a second WiFi frequency range different than the first WiFi frequency range, the antenna comprising:

a base plate;

a plurality of vertically polarized antenna element modules on the base plate; and a plurality of horizontally polarized antenna element modules on the base plate;

wherein each said antenna element module includes a radiating element and a ground plane/reflector and is operable for radiating a symmetrical directional beam in a same direction generally perpendicular and away from the ground plane/reflector at the first and second WiFi frequency ranges.

2. The antenna of claim 1, wherein:

the antenna is operable with a directional radiation pattern at both of the first WiFi frequency range that is from about 2.4 Gigahertz (GHz) to about 2.5 GHz, and the second WiFi frequency range that is from about 5.15 GHz to about 5.9 GHz; and/or the antenna includes two of said vertically polarized antenna element modules and two of said horizontally polarized antenna element modules.

3. The antenna of claim 1, wherein each said antenna module includes a feeding board configured to be operable for exciting the radiating element, and wherein each said radiating element:

a first electrically-conductive part including an outer perimeter and first and second portions extending inwardly away from the outer perimeter and towards each other; and a second electrically-conductive part including first and second end portions, a middle portion coupled to the ground plane/reflector, and first and second connecting portions extending between the middle portion and the corresponding first and second end portions; and the first and second electrically-conductive parts are coupled together or formed integrally with each other.

4. The antenna of claim 1, wherein the ground plane/reflector includes a bottom portion and one or more sidewalls that are disposed generally around the radiating element, whereby the bottom portion and the one or more sidewalls are operable for reflecting and/or directing signals from the radiating element in a direction generally perpendicular and away from the bottom portion of the ground plane/reflector.

5. The antenna of claim 1, wherein the ground plane/reflector includes a bottom portion and four sidewalls that defining a generally square perimeter in which the radiating element is generally centrally located.

6. The antenna of claim 1, wherein each said radiating element includes a first electrically-conductive part and a second electrically-conductive part coupled to the first electrically-conductive part and to the ground plane/reflector, and wherein:

the first electrically-conductive part of the radiating element includes an outer perimeter and first and second portions extending inwardly away from the outer perimeter and towards each other without making contact such that the first electrically-conductive part is annular with an opening; and/or the second electrically-conductive part of the radiating element includes first and second end portions, a middle portion coupled to the ground plane/reflector, and first and second connecting portions extending between the middle portion and the corresponding first and second end portions.

7. The antenna of claim 1, wherein:

the antenna further comprises a plurality of cables each connected to a corresponding one of the antenna element modules; and the plurality of vertically polarized antenna element modules and the plurality of horizontally polarized antenna element modules are configured to be operable for providing a multiple input multiple out (MIMO) access point with space and polarization diversity; and the antenna is configured to be operable in the first and second WiFi frequency ranges with about a 9 dBi gain and with a symmetrical consistent beam of about 65 degrees by 65 degrees.

8. A system comprising one or more antennas according to claim 1, wherein the system is a panel antenna system and/or a multiple input multiple output (MIMO) antenna system.

9. An antenna operable within at least a first WiFi frequency range and a second WiFi frequency range different than the first WiFi frequency range, the antenna comprising:

a base plate;

a plurality of vertically polarized antenna element modules on the base plate; and a plurality of horizontally polarized antenna element modules on the base plate;

wherein each said antenna element module includes a radiating element, a feeding board configured to be operable for exciting the radiating element, and a ground plane/reflector, whereby the radiating element is operable for radiating a symmetrical directional beam at a direction generally perpendicular and away from the ground plane/reflector at the first and second WiFi frequency ranges;

wherein:

the feeding board includes a resistive network and a microstrip line along a first side of the feeding board, and a coaxial cable is connected to the feeding board by a feed-through along a second side of the feeding board opposite the first side; and/or the feeding board is positioned within a slot defined by the ground plane/reflector and a slot defined by the radiating element such that upper and lower portions of the feeding board are on opposite sides of the ground plane/reflector and the upper portion of the feeding board is within an interior defined between portions of the radiating element.

10. An antenna operable within at least a first WiFi frequency range and a second WiFi frequency range different than the first WiFi frequency range, the antenna comprising:

a base plate;

a plurality of vertically polarized antenna element modules on the base plate; and a plurality of horizontally polarized antenna element modules on the base plate;

wherein each said antenna element module includes a radiating element and a ground plane/reflector, whereby the radiating element is operable for radiating a symmetrical directional beam at a direction generally perpendicular and away from the ground plane/reflector at the first and second WiFi frequency ranges;

wherein each said radiating element includes a first electrically-conductive part and a second electrically-conductive part coupled to the first electrically-conductive part and to the ground plane/reflector; and wherein:

the first electrically-conductive part of the radiating element includes a generally rectangular outer perimeter and first and second portions extending inwardly from corresponding first and second longer sides of the generally rectangular outer perimeter; and the second electrically-conductive part of the radiating element includes:

first and second end portions respectively coupled to the corresponding first and second portions of the first electrically-conductive part;

a middle portion coupled to the ground plane/reflector; and first and second connecting portions extending between the middle portion and the corresponding first and second end portions.

11. A multiband WiFi directional antenna comprising:

a base plate;

one or more vertically polarized antenna element modules on the base plate; and one or more horizontally polarized antenna element modules on the base plate;

wherein each said antenna element module includes:

a radiating element;

a feeding element configured to be operable for exciting the radiating element; and a ground plane/reflector having a bottom portion coupled to the radiating element, and one or more sidewalls that are disposed generally around the radiating element;

whereby the multiband WiFi directional antenna is operable within at least a first WiFi frequency range and a second WiFi frequency range different than the first WiFi frequency range with each said antenna module operable for radiating a symmetrical directional beam in a same direction generally perpendicular and away from the bottom portion of the ground plane/reflector at the first and second WiFi frequency ranges.

12. The multiband WiFi directional antenna of claim 11, wherein the ground plane/reflector is configured to be operable for reflecting and/or directing signals from the radiating element in the same general direction such that each radiating element radiates a symmetrical directional beam in the same general direction at the first and second WiFi frequency ranges, and wherein each said radiating element:

a first electrically-conductive part including an outer perimeter and first and second portions extending inwardly away from the outer perimeter and towards each other; and a second electrically-conductive part including first and second end portions, a middle portion coupled to the ground plane/reflector, and first and second connecting portions extending between the middle portion and the corresponding first and second end portions; and the first and second electrically-conductive parts are coupled together or formed integrally with each other.

13. The multiband WiFi directional antenna of claim 11, wherein each said radiating element radiates a symmetrical directional beam in the same direction generally perpendicular and away from the bottom portion of the ground plane/reflector at the first and second WiFi frequency ranges, and wherein:

the first electrically-conductive part of the radiating element includes an outer perimeter and first and second portions extending inwardly away from the outer perimeter and towards each other without making contact such that the first electrically-conductive part is annular with an opening; and/or the second electrically-conductive part of the radiating element includes first and second end portions, a middle portion coupled to the ground plane/reflector, and first and second connecting portions extending between the middle portion and the corresponding first and second end portions.

14. The multiband WiFi directional antenna of claim 11, wherein:

the first WiFi frequency range is from about 2.4 Gigahertz (GHz) to about 2.5 GHz, and the second WiFi frequency range is from about 5.15 GHz to about 5.9 GHz; and/or the multiband WiFi directional antenna includes two of said vertically polarized antenna element modules and two of said horizontally polarized antenna element modules.

15. The multiband WiFi directional antenna of claim 11, wherein the one or more sidewalls of the ground plane/reflector are four sidewalls that defining a generally square perimeter in which the radiating element is generally centrally located.

16. The multiband WiFi directional antenna of claim 11, wherein each said radiating element includes a first electrically-conductive part and a second electrically-conductive part coupled to the first electrically-conductive part and to the ground plane/reflector, and wherein:

the first electrically-conductive part of the radiating element includes an outer perimeter and first and second portions extending inwardly away from the outer perimeter and towards each other without making contact such that the first electrically-conductive part is annular with an opening; and/or the second electrically-conductive part of the radiating element includes first and second end portions respectively coupled to the first electrically-conductive part, a middle portion coupled to the ground plane/reflector, and first and second connecting portions extending between the middle portion and the corresponding first and second end portions.

17. The multiband WiFi directional antenna of claim 11, wherein:

the antenna further comprises a plurality of cables each connected to a corresponding one of the antenna element modules; and the plurality of vertically polarized antenna element modules and the plurality of horizontally polarized antenna element modules are configured to be operable for providing a multiple input multiple out (MIMO) access point with space and polarization diversity; and the multiband WiFi directional antenna is configured to be operable in the first and second WiFi frequency ranges with about a 9 dBi gain and with a symmetrical consistent beam of about 65 degrees by 65 degrees.

18. A system comprising one or more multiband WiFi directional antennas according to claim 11, wherein the system is a panel antenna system and/or a multiple input multiple output (MIMO) antenna system.

19. A multiband WiFi directional antenna comprising:

a base plate;

one or more vertically polarized antenna element modules on the base plate; and one or more horizontally polarized antenna element modules on the base plate;

wherein each said antenna element module includes:

a radiating element;

a feeding element configured to be operable for exciting the radiating element; and a ground plane/reflector having a bottom portion coupled to the radiating element, and one or more sidewalls that are disposed generally around the radiating element;

whereby the multiband WiFi directional antenna is operable within at least a first WiFi frequency range and a second WiFi frequency range different than the first WiFi frequency range;

wherein:

the feeding element includes a resistive network and a microstrip line along a first side of the feeding element; and a coaxial cable is connected to the feeding element by a feed-through along a second side of the feeding element opposite the first side; and/or the feeding element is positioned within a slot defined by the ground plane/reflector and a slot defined by the radiating element such that upper and lower portions of the feeding element are on opposite sides of the ground plane/reflector and the upper portion of the feeding element is within an interior defined between portions of the radiating element.

20. A multiband WiFi directional antenna comprising a base plate;

one or more vertically polarized antenna element modules on the base plate; and one or more horizontally polarized antenna element modules on the base plate;

wherein each said antenna element module includes:

a radiating element;

a feeding element configured to be operable for exciting the radiating element; and a ground plane/reflector having a bottom portion coupled to the radiating element, and one or more sidewalls that are disposed generally around the radiating element;

whereby the multiband WiFi directional antenna is operable within at least a first WiFi frequency range and a second WiFi frequency range different than the first WiFi frequency range;

wherein each said radiating element includes a first electrically-conductive part and a second electrically-conductive part coupled to the first electrically-conductive part and to the ground plane/reflector; and wherein:

the first electrically-conductive part of the radiating element includes a generally rectangular outer perimeter and first and second portions extending inwardly from corresponding first and second longer sides of the generally rectangular outer perimeter; and the second electrically-conductive part of the radiating element includes:

first and second end portions respectively coupled to the corresponding first and second portions of the first electrically-conductive part;

a middle portion coupled to the ground plane/reflector; and first and second connecting portions extending between the middle portion and the corresponding first and second end portions.

* * * * *